US006293018B1

(12) United States Patent
Rivera

(10) Patent No.: US 6,293,018 B1
(45) **Date of Patent: *Sep. 25, 2001**

(54) MULTIPURPOSE TOOL INCLUDING HANDLES HAVING SEPARATE SIDES

(75) Inventor: Benjamin C. Rivera, West Linn, OR (US)

(73) Assignee: Leatherman Tool Group, Inc., Portland, OR (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/065,757

(22) Filed: Apr. 24, 1998

Related U.S. Application Data

(63) Continuation of application No. PCT/US96/19308, filed on Nov. 27, 1996, which is a continuation-in-part of application No. 08/563,922, filed on Nov. 29, 1995, now Pat. No. 5,745,997.

(51) Int. Cl.[7] ..... B26B 1/00; B26B 7/22

(52) U.S. Cl. ..... 30/155; 7/128; 7/168; 81/427.5

(58) Field of Search ..... 30/255, 261, 155, 30/159–161; 81/427.5, 440, 177.4, 177.6, 490; 7/167–168, 158, 127–135, 118

(56) References Cited

U.S. PATENT DOCUMENTS

| | | | |
|---|---|---|---|
| 187,483 | 2/1877 | Rightor . | |
| 716,623 | 12/1902 | Brouillette . | |
| 1,046,361 | 12/1912 | Wulff | 294/99.2 |
| 4,238,862 | 12/1980 | Leatherman | 7/128 |
| 4,744,272 | 5/1988 | Leatherman | 81/427.5 |
| 4,888,869 | 12/1989 | Leatherman | 30/161 |
| 5,142,721 | 9/1992 | Sessions et al. | 7/128 |
| 5,212,844 | 5/1993 | Sessions et al. | 7/128 |
| 5,537,750 | 7/1996 | Seber et al. | 30/161 |
| 5,546,662 | 8/1996 | Seber et al. | 30/161 |
| 5,743,582 | 4/1998 | Rivera | 294/99.2 |
| 5,745,997 | 5/1998 | Berg et al. | 30/155 |

FOREIGN PATENT DOCUMENTS

WO 98/18599 5/1998 (WO) .

*Primary Examiner*—D. S. Meislin
(74) *Attorney, Agent, or Firm*—Chernoff, Vilhauer, McClung & Stenzel, LLP

(57) ABSTRACT

A multipurpose folding tool (30, 280) including a pair of folding scissors (32), in which scissors blades (80, 82) are movable about pivot shafts (78), between a stowed position and a deployed position in the handles (34, 36). A rocker (94, 96) is moved by a spring (106) in the tool handle and in turn urges a scissors blade toward an open position. In one embodiment four springs (104, 106) hold the handles together with the folded scissors stowed within the handles. When the scissors and other tools are folded into their stowed positions in the handle of the multipurpose tool of the invention the tool has a smooth outside configuration allowing the tool to be carried in a pocket without causing undue wear. A handle (34 or 36) may be constructed as a sheet metal channel or a handle (282, 284, 382, 384) in two pieces at least one of which includes a perpendicular flange taking the place of a channel bottom portion so that each blade or tool bit may be accompanied by a separate spring (318, 418, 420).

8 Claims, 13 Drawing Sheets

382
410
414
418
422
426
424
392
394
404
386
388
390
408
26
380
430
409
384
412
398
400
24
25
406
402
428
416
419
420
417
427
407

MULTIPURPOSE TOOL INCLUDING HANDLES HAVING SEPARATE SIDES

This application is a continuation of International patent application Serial No. PCT/US96/19308, filed Nov. 27, 1996, which is a continuation-in-part of U.S. patent application Ser. No. 08/563,922, filed Nov. 29, 1995 now U.S. Pat. No. 5,745,997.

TECHNICAL FIELD

The present invention relates to multipurpose folding tools, and in particular to a handle structure and pivotally interconnected blades or jaws for such tools.

BACKGROUND ART

Folding scissors of various types have been known for many years and have long been included in multipurpose folding tools. In the past, most folding scissors in such multipurpose tools have been very small, and therefore relatively ineffective.

One type of folding scissors in a multipurpose tool is disclosed, for example, in Moser U.S. Pat. No. 696,995. In that type of tool one blade of a pair of scissors has an extended handle which is attached to pivot the entire pair of scissors into a storage slot in a knife handle. A second handle and its attached scissors blade are also stowed in the same slot, with the scissors blades and handles generally parallel with one another. A small leaf spring is typically used to urge the handles apart from each other to open the blades of such a pair of miniature scissors, and the spring is kept compressed when the scissors are in the stowed position. The spring typically used in such scissors is easily lost or accidentally bent to an inoperative condition.

East German Patent Publication 2,322,229 discloses another type of folding scissors using a long spring in a handle of a tool to move an auxiliary lever to urge a handle of a movable scissors blade in a blade-opening direction. This arrangement, however, fails to hold the handle of the main scissors blade stably fixed relative to the tool handle when the movable scissors handle and blade are urged in a blade-closing direction with respect to the main blade.

German Patent No. 145784 discloses a tool incorporating a folding handle with a pair of scissors blades which can be stowed within a multipurpose tool handle, but such scissors include the previously mentioned type of spring or none at all.

In previously-known folding scissors including a spring for opening the scissors blades, the force needed to move the blades in a closing or cutting direction has increased with continued closing movement of the blades. It is therefore desired to provide scissors which are easier to use in that the force needed to close the blades completely is not greatly increased over that required to close the blades partially during a cutting stroke of the scissors.

Many types of multipurpose pocket tools and pocket knives are known in which various knife blades, screwdrivers or other tool bits fold into storage locations within either a handle, or pair of handles. In some such multipurpose pocket tools, the handles are configured as channels of formed sheet metal that are able to pivot around the bases of a central pair of tool blades or jaws to reduce the size of the channel shaped handles as the outer surface of the folded tool.

In the case of previously known multipurpose folding hand tools, the typical channel-shaped handles do not provide spring pressure separately to each blade in order to hold it in the closed or open position. There is typically one spring, usually integral to the handle, which cannot hold all the blades contained within closed without some looseness. Therefore, the typical way to hold the blades closed is by side friction applied by the blade pivot pin. Blade looseness may allow the tips of the blades to open slightly, exposing the sharp and potentially dangerous edges. Side friction can sometimes be overcome by a jolt to the tool, causing the blades to unfold partially, exposing the sharp and potentially dangerous edges. The ideal side friction required for holding the blades in the channel-shaped handles without individual springs requires manual adjustment and is difficult to achieve. Channel-shaped handles are thus difficult to manufacture and assemble. For these reasons, it has become customary for good tool design to dictate that handles of a pair first be spread apart from each other in order to gain access to the blades contained within the handles. When the tool is folded closed, the opposite tool handles prevent the accidental partial opening of the blades.

In some pocket knives, the handles are configured as generally flat pieces of sheet metal which sandwich the various blades. Each blade pivots about a pin located at its base and is held either open or closed by an individual spring which must be supported at its base and near its center in order to provide adequate spring pressure. This center support is typically provided by a pin.

Each blade of a pocket knife typically has its own individual spring to bias it closed. This allows the blades safely to be located on the outside of the tool, as they cannot accidentally open. If a jolt to the knife partially opens a blade, its spring forces it closed again. The typical generally flat handle pieces are what provide support to keep the three pins where they are required to make the individual springs work. The individual spring and three-pin design, however, represents less efficient use of space than the channel-shaped handle design typically used in multipurpose folding hand tools.

What is needed, then, is an improved multipurpose folding tool including a central folding tool easily used, and which does not interfere with the utility of other folding tool bits included in the multipurpose folding tool. It is also desired for such folding scissors to be larger than previously available folding scissors included in a multipurpose folding tool of a comparable size, and that the entire tool in a folded configuration can be easily carried in a person's pocket without causing unnecessary wear of the fabric of the pocket. It is also desired for individual blades of a multipurpose tool to be held securely so that they can safely be located on the outer side of a handle of such tool in its folded configuration. Finally, it is desired for such a multipurpose tool to be simple to assemble and to be able to be assembled in different arrangements.

DISCLOSURE OF THE INVENTION

The present invention provides a multipurpose folding tool which overcomes the previously-mentioned shortcomings and disadvantages of previously known folding tools by providing improved folding scissors and other tools having pivotally interconnected jaws or the like.

In one embodiment of the present invention a channel-shaped folding handle is attached to each of a pair of interconnected movable members such as the blades of a pair of scissors and a pair of springs in each handle operate, respectively, on the attached member, such as a scissors blade, and on an adjacent rocker. Both of such springs in each handle operate to hold the handles together with the multipurpose tool in a folded configuration. With the scissors, for example, ready for use, one spring in each handle holds the attached scissors blade securely aligned with the handle, while the other spring operates the associated rocker to urge the scissors blades toward an open position after each cutting stroke. Each rocker is linked with the adjacent scissors blade so that the rocker is free to pivot through a small angle relative to the blade but is moved along with the blade between the stowed position and the deployed position of the blade.

In a preferred embodiment of the invention, additional folding tool bits are included in the handles, mounted on tool pivot shafts spaced apart in the handles from the location of the scissors blades. When such tool bits are used, the handles are prevented from moving laterally with respect to each other in one embodiment of the invention by an ear on one of the springs in each handle and by a portion of each rocker extending alongside the scissors blade associated with the other handle.

In one embodiment of the invention a lanyard-attachment ear mounted on a pivot shaft may be extended for use or folded into a stored position where it is not likely to wear the fabric of a pocket in which the tool is carried.

Another embodiment of the present invention also provides a means of simplifying the manufacture and assembly of multipurpose folding hand tools by eliminating the channel-shaped handle construction while maintaining the efficient use of space provided by the channel-shaped handle design. In this embodiment of the invention, the traditional channel-shaped handle is replaced by two L-shaped handle pieces each having a flange included in a piece which is a side of a handle. Blades may be mounted at either end of the handle on pins which join the sides of the handle to each other. Each blade has its own spring which is attached to the handle by a pin or shaft through its base portion at the opposite end of the handle. Each spring is supported near its center by the flange that forms the leg of the L-shaped handle piece.

In multipurpose folding hand tools, this aspect of the invention allows the incorporation of an individual spring for each of the blades or other tool bits contained within the handles. These springs bias the individual blades closed and allow them to be accessible from the outside of the tool when the handles are folded closed without sacrificing safety. This eliminates the time-consuming task of opening the tool handles in order to open or fold away a blade. Manufacture is simplified by use of L-shaped handle pieces because handle side parallelism and hole alignment are facilitated, polishing is simplified because of improved access to the inside, and heat treatment warpage is reduced because of reduced internal stresses and increased robustness of the part. Assembly is simplified by eliminating the channel structure because the components can be stacked up one piece at a time, including the handle pieces, and fastened together rather than the internal components having to be stacked up and inserted into the channel structure.

According to this aspect of the invention two L-shaped handle pieces, the second one generally being the mirror image of, and optionally rotated 180° from the first, replace the usual flat side pieces. There are two holes in each handle piece which, when arranged as described, generally line up with each other in order to accept pins which will attach the two pieces together.

In various embodiments of this aspect of the invention, blades or other tool bits may be attached at only one end, or at each end, of the handle. The blades may all fold out of one side of the handle, or from both sides. Each blade has its own spring, supported near its center by the flange, the leg of the L-shaped handle piece. This leg of the "L" efficiently replaces the traditional third pin. The spring for each blade also serves as a spacer for that blade at the opposite end of the handle. The number of blades a handle may contain is thus limited only by the width of the flange and the thickness of the blades and springs.

Laterally adjacent blades or tool bits in a handle are engaged by tapered tips of adjacent springs each engaging only a particular one of the adjacent blades.

In other embodiments of the invention, pliers or other tools may include jaws or jawlike members pivotally interconnected with each other and arranged to be folded and stowed in tool handles in a manner similar to that in which the scissors blades operate and are interrelated with the tool handles.

In one such embodiment of the invention at least one and preferably each of a pair of opposite handle sides includes a flange extending over most of its length, and a leaf spring extends from the flange longitudinally of the handle to bear on a surface of the base of a foldable tool blade. A pair of such handles may each have a base of one of a pair of pliers jaws between the handle sides at one end of each handle, while knife blades or other tool bits are located at the end of the handle where the leaf spring is located.

The foregoing and other objectives, features, and advantages of the invention will be more readily understood upon consideration of the following detailed description of the invention, taken in conjunction with the accompanying drawings.

BEST MODES FOR CARRYING OUT THE INVENTION

Figure 1:
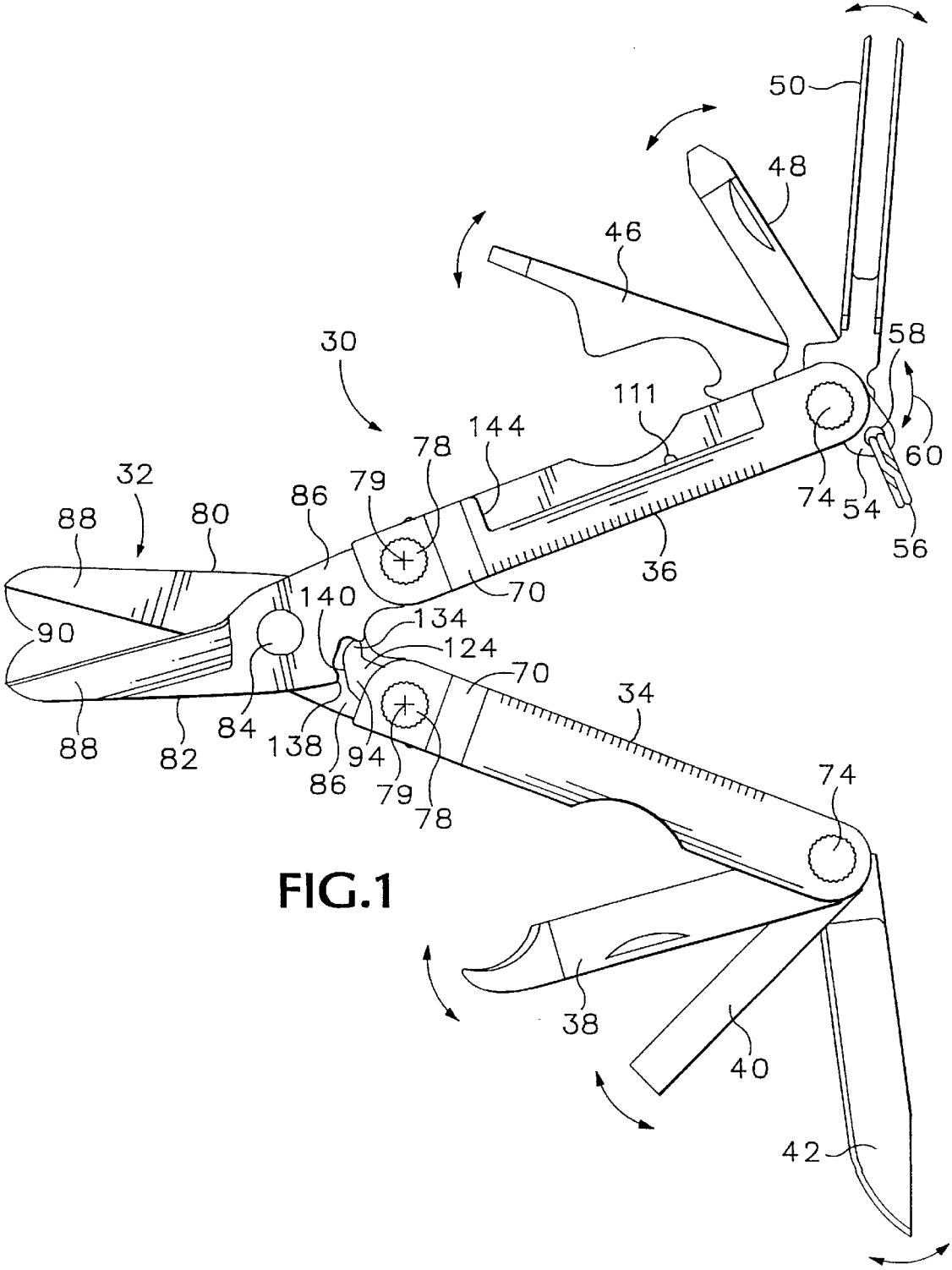
FIG. 1 is an elevational view of a multipurpose folding tool which is an embodiment of the present invention.
Figure 2:
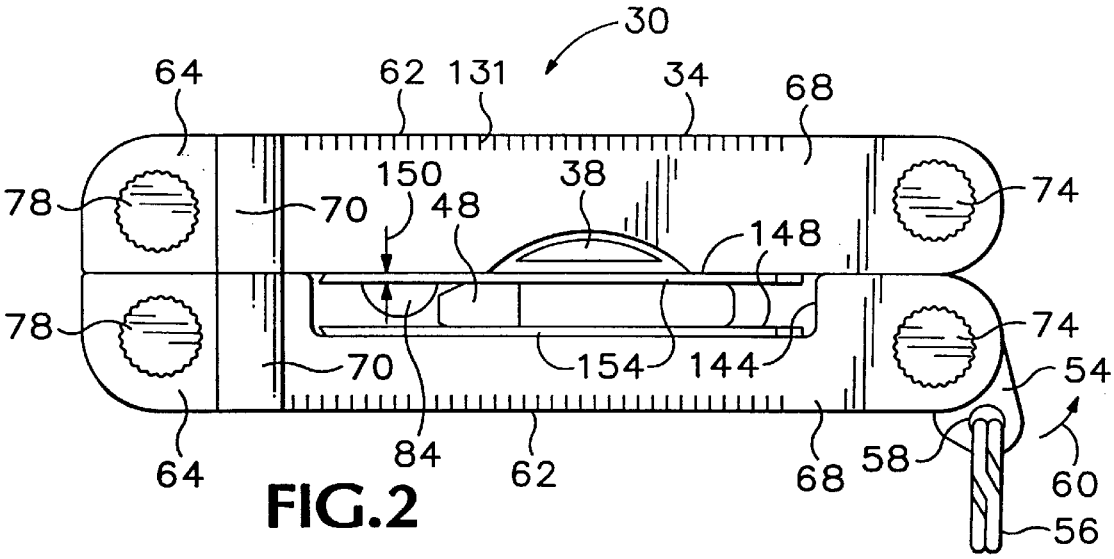
FIG. 2 is a left side view of the tool shown in FIG. 1, in a folded configuration.

Referring now to FIGS. 1–13 of the drawings which form a part of the disclosure herein, a folding multipurpose tool 30 includes a pair of folding scissors 32 which can be received within a pair of handles 34 and 36 when the tool 30 is in a folded configuration as shown in FIGS. 2–7. Additional tool bits, such as a nail file 38, a medium screwdriver 40, and a knife blade 42, may be stowed within a cavity 44 defined within the first handle 34, and a combined small screwdriver and cap lifter 46, a flat Phillips screwdriver 48, and a pair of tweezers 50 may be stowed within a cavity 52 defined within the second handle 36. The just-mentioned additional tool bits may each be extended to a position parallel with the respective handle 34 or 36 for use. A lanyard attachment ear 54 is attached to the second handle 36, and a split ring 56 or other suitable fastening device may be engaged in a hole 58 defined in the lanyard receiving ear 54. The lanyard receiving ear 54 is movable in the direction indicated by the arrow 60, as will be discussed in greater detail subsequently.

Figure 5:
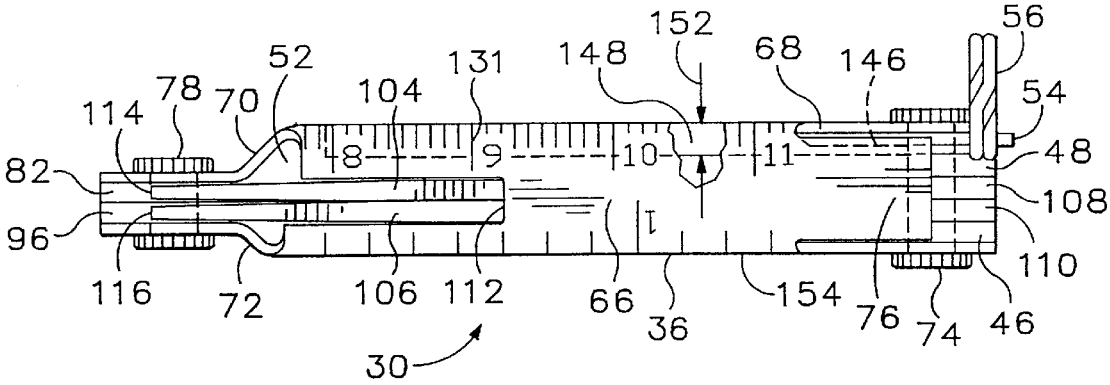
FIG. 5 is a bottom view of the tool shown in FIG. 1, in the folded configuration shown in FIG. 2.

Each of the handles 34 and 36 includes a wide portion 62 and a narrow scissors-end portion 64, formed appropriately of stainless steel sheet generally in the form of a channel including a bottom portion 66 (see FIG. 5). Respective side walls 68 extend generally perpendicularly away from the bottom 66 and parallel with each other except in tapering portions 70 and 72.

A tool pivot shaft 74, which may be a tubular internally threaded screw fastener with a mating externally threaded counterpart, is located in the wide portion 62 of each of the handles 34 and 36, extending transversely between the side walls 68 at a tool bit end of each handle. During assembly of the tool 30 the tool pivot shafts 74 are adjusted to provide sufficient tension to ensure a snug fit between the sidewalls 68 for the members rotating thereon, yet permit smooth movement, and are then held in the required position by an adhesive. The tool pivot shafts 74 act as fulcrums for each of the tool bits such as the knife blade 42 and tweezers 50. A leaf spring 76 is a cantilevered extension of the bottom 66 and bears upon the base portion of each of the folding tool bits to hold them selectively in an extended position, parallel with the respective handle 34 or 36 and ready for use.

At the scissors-end portion 64 of each handle, a respective scissors pivot pin 78, which may also be called a jaw pivot pin, is a fastener similar to the tool pivot shaft 74, but shorter.

The folding scissors 32 included in the folding tool 30 include a pair of blades, a first scissors blade 80 and a second scissors blade 82, which pivot with respect to each other about a scissors pivot joint 84 defined, for example, by a fastener such as a countersunk rivet interconnecting the two scissors blades 80 and 82. First and second scissors blades 80 and 82 are identical with each other, but are given different reference numbers here to facilitate understanding of their interaction with each other. Each of the blades 80 and 82 includes a respective base portion 86 extending from the scissors pivot joint 84 toward the respective handle 34 or 36 with which the particular blade is interconnected. A cutting portion 88 of each blade extends away from the scissors pivot joint 84 and culminates in a blade tip 90. The base portion 86 of each of the scissors blades 80 and 82 includes an aperture 92 that fits snugly around a respective one of the scissors pivot pins 78 in handle pivots which define respective handle pivot axes 79 about which each base portion 86 rotates with respect to the respective handle 34 or 36.

Each of a pair of identical rockers 94 and 96 includes an aperture 98 which also fits around a respective scissors pivot pin 78, permitting each of the rockers 94, 96 to pivot smoothly about the respective scissors pivot pin 78 which thus defines a respective rocker pivot axis coinciding with the handle pivot axis 79. The rocker 94 is thus associated with and located alongside the first scissors blade 80, and the rocker 96 is associated with and located alongside the second scissors blade 82. The scissors pivot pin 78 is preferably of a length which when fully tightened leaves some axial clearance for the scissors blade base portion 86 and the respective rocker 94 or 96 so that they are generally free to move relative to each other, the pin 78, and the respective handle 34 or 36, as will be explained presently.

Each of the rockers 94 and 96 includes a projecting pin 100, which may be made as a separate piece and fastened thereto but preferably is formed by swaging the rocker. The pin 100 projects toward and into a slot 102 in the base portion 86 of the adjacent scissors blade 80 or 82, which receives the pin 100 of the associated rocker 94 or 96 and permits the rocker to rotate through only a limited angle with respect to the associated scissors blade 80 or 82, about the rocker pivot axis defined by a respective scissors pivot pin 78. While the slot 102 is shown as a kidney-shaped slot extending entirely through the base portion 86 of each scissors blade 80 or 82, it is conceivable that the slot 102 may be of another shape or may not extend the entire distance through the respective base portion 86, so long as it receives the pin 100 and thus limits movement of the respective rocker when the rocker and base portion are located closely alongside each other.

Included within each of the handles 34 and 36 are a pair of springs, a scissors blade spring 104 and a rocker spring 106. As may be seen in FIGS. 5 and 7, these springs are generally similar in shape and are located side-by-side within each cavity 44 or 52. An anchoring end 108 of the scissors blade spring 104 and an anchoring end 110 of the rocker spring 106 include apertures which fit snugly on the respective tool pivot shaft 74. A hump 111 located in a middle portion of each rocker spring 106 protrudes into the cavity 44 or 52. A similar hump 111 is preferably present in the corresponding location on each scissors blade spring 104, but could optionally be omitted.

The springs 104 and 106 extend along the bottom 66 over a portion of the length of each handle 34, 36 to the bottom 112 of a slot defined in the end of bottom 66 nearer to the scissors pivot pin 78 of each handle. The respective tips 114, 116, of the scissors blade spring 104 and rocker spring 106 extend along the slot in the bottom 66 and are thus free to move toward and away from the respective scissors pivot pins 78, in contact with and following the shapes of the respective base portions 86 and rockers 94, 96, but the sides of the slot 112 keep the springs 104 and 106 from moving laterally and thus keep them aligned with the respective scissors blade 80 or 82 and rocker 94 or 96.

The tips 116 of the rocker springs, are each tapered in width to be about 0.025 inch narrower than the anchoring ends 108 and 110, to provide lateral clearance between the adjacent spring tips 114 and 116, as shown in FIG. 5. This ensures that the springs can flex and the spring tips 114 and 116 can move independently of each other without the need for a spacer plate between the springs 104 and 106. The spring tips 116 are each also about 0.02 inch narrower than the thickness of each of the rockers 94, 96 on which they act, to ensure that the spring tips 116 engage only the intended rocker 94 or 96. The blade spring tips 114 may similarly be tapered in width, but it may be desirable not to taper the blade spring tips, in order to have the blade spring tips 114 as strong as practical where they contact the base portions 86 of the scissors blades. The anchoring ends 108 and 110, on the other hand, are together about 0.010 inch thicker than the combined thicknesses of the scissors blades 80, 82 and the rockers 94 and 96 so that the blades and rockers can be moved easily into the cavities 44 and 52 of the handles 34, 36.

With the folding tool 30 in the folded configuration shown in FIGS. 2–7, a generally flat surface 118 of each base portion 86 rests against each scissors blade spring tip 114, and a generally flat surface 120 on each rocker 94 or 96 rests against the rocker spring tip 116, with the respective tips 114 and 116 pressing against the flat surfaces 118 and 120.

Figure 7:
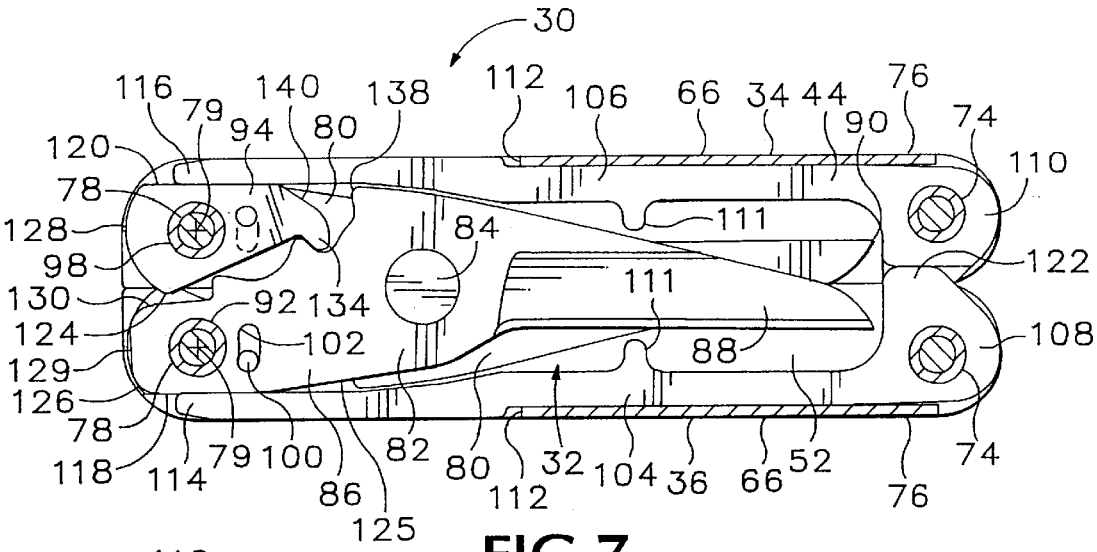
FIG. 7 is a sectional view of the multipurpose tool shown in FIG. 1, taken along line 7—7 of FIG. 4.

The springs 104 thus urge the scissors blades 80, 82 to rotate about the respective scissors pivot pins 78 toward the stowed position shown best in FIG. 7, with the base portion 86 of each of the scissors blades 80, 82 nested snugly between the respective scissors blade spring 104 and the oppositely located rocker spring 106. As a result, the scissors blades are rotated with respect to each other about the scissors pivot joint 84 so that the blade tips 90 are located about 10° past each other, in a crossing configuration, when the scissors blades 80, 82 are in their respective stowed positions within the cavities 44, 52 defined by the handles 34, 36.

At the same time, the rocker springs 106 press against the flat surfaces 120 of the rockers 94, 96 urging them to rotate in the same direction as the respective base portion 86 with which each rocker is linked by the respective combination of a pin 100 and slot 102. The pin 100 is located so as to be in contact with the interior surface defining the slot 102 so that the force of the rocker spring 106 is carried through the in 100 and slot 102 and helps to urge the scissors lades to rotate into the respective cavity 44 or 52 defined within the handle 34 or 36 with which the respective scissors blade 80 or 82 is interconnected. Because the scissors blades 80, 82 are interconnected through the scissors pivot joint 84, all four springs, both of the scissors blade springs 104 and both of the rocker springs 106, urge the scissors blades 80, 82 into the crossing configuration shown in FIG. 7 and urge the handles 34, 36 together to retain the tool 30 in its folded configuration.

Figure 3:
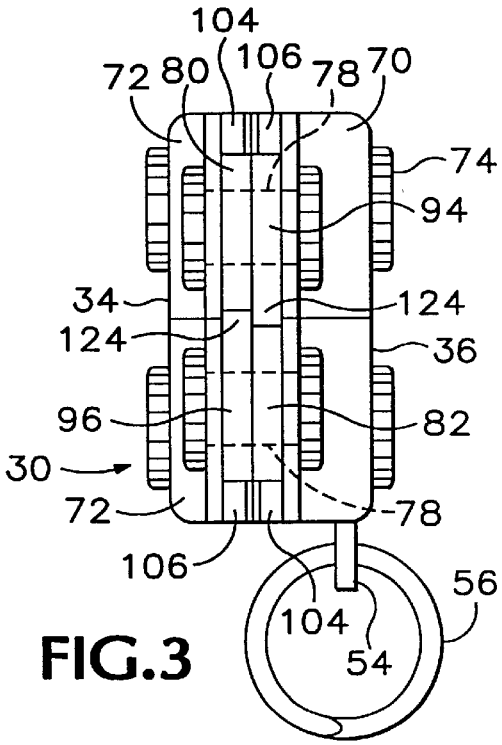
FIG. 3 is a scissors end view of the tool shown in FIG. 1, in the folded configuration shown in FIG. 2.
Figure 4:
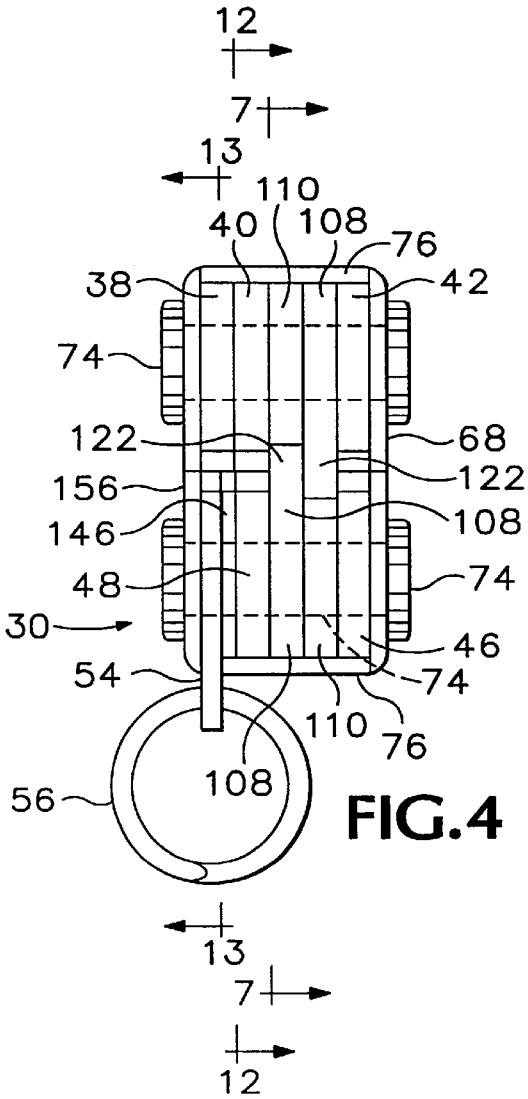
FIG. 4 is a tool bit end view of the tool shown in FIG. 1, in the folded configuration shown in FIG. 2.

When the tool 30 is in the folded configuration the ends of the handles 34 and 36 are held aligned with each other laterally by protruding ears 122 located on the anchoring ends 108 of the scissors blade springs 104, and by cam lobes 124 included in each of the rockers 94, 96. The ears 122 overlap and are located alongside each other and between each other and the base of an adjacent folded tool blade, as shown in FIG. 4, keeping the tool bit ends of the handle aligned with each other. The cam lobes 124 similarly extend alongside each other and between each other and one of the side walls 68 in the narrow scissors end portion 64 of the opposite handle 34 or 36, as shown in FIG. 3, keeping the scissors ends of the handles 34, 36 aligned. The ears 122 may, as shown in FIG. 4, be slightly narrower than the rest of the anchoring end 108 or 110 to avoid interference as they pass by each other as the tool 30 is being folded. It will be understood that the ears 122 might be provided on the rocker springs 106 instead of the scissors blade springs 104 with the same results.

Each scissors blade 80 and 82 has an outer margin 125 which rests closely along an inner surface of the tip 116 and a very small distance away from the hump 111 of the opposite rocker spring 106 inside the opposite cavity 44 or 52. The tool 30 in its folded configuration thus is as compact as practical, yet each scissors blade incorporates all the material for which there is room within the cavity to ensure adequate strength.

Figure 8:
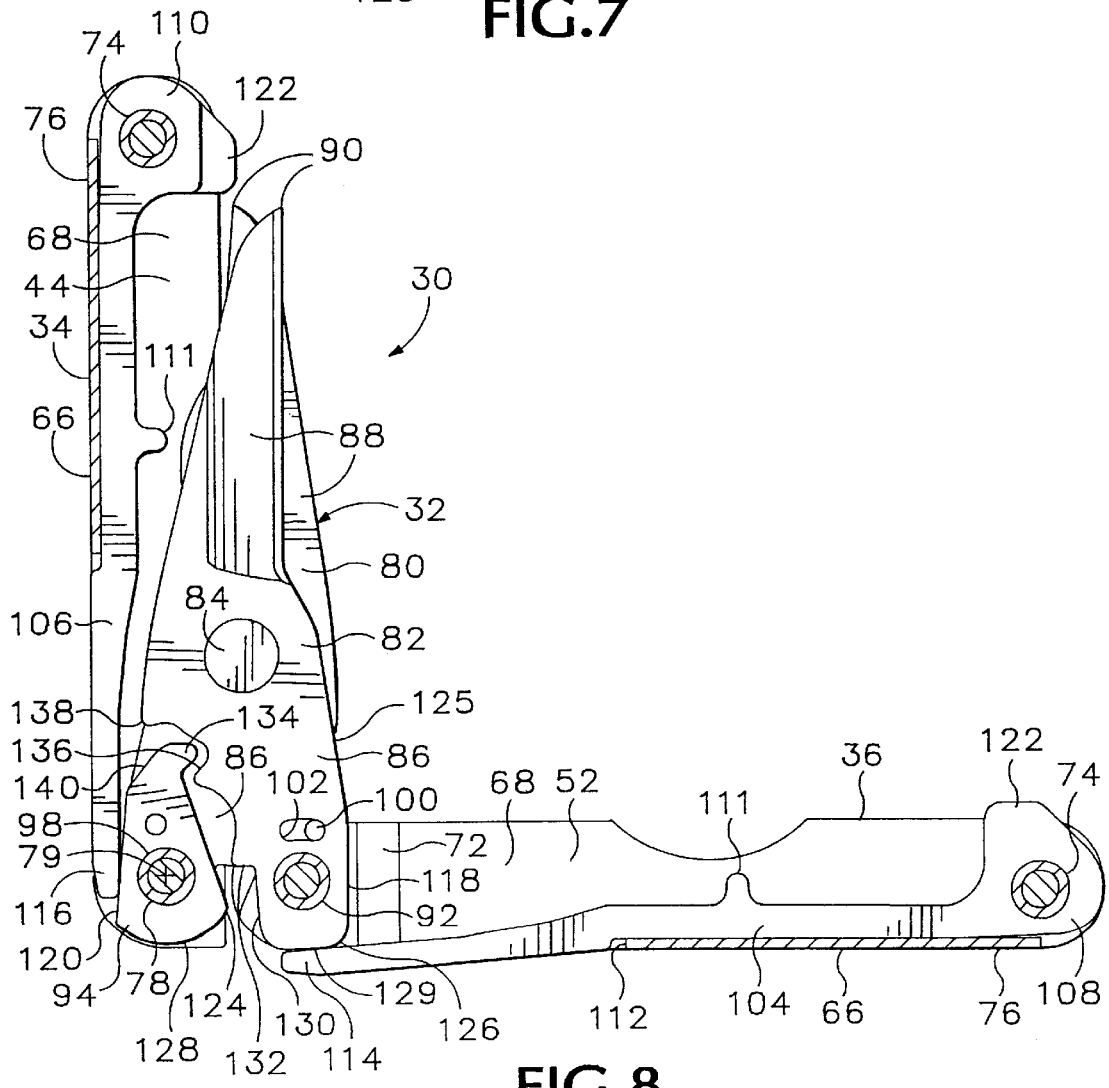
FIG. 8 is a sectional view similar to that of FIG. 7, showing the multipurpose tool with one handle in a partially extended position.

For use, the scissors 32 are deployed from the folded configuration of the folding tool 30 by separating the handles 34, 36, rotating each of the scissors blades 80, 82 about one of the scissors pivot pins 78 with respect to the handle 34 or 36 with which it is interconnected. As the scissors blades 80, 82 are rotated with respect to the handles 34, 36, for example, by rotation of the second blade 82 with respect to the handle 36 to the position shown in FIG. 8, both the scissors blade spring 104 and rocker spring 106 of the respective handle are forced to flex away from the scissors pivot pin 78 by respective cam surfaces 126 of the base portions 86 of the scissors blades, and similar cam surfaces 128 of the rockers 94, 96. The cams at first strongly resist movement of the scissors blades 80 and 82 away from their stowed positions within the cavities 44 and 52, and because of the linking provided by the pin 100 within the slot 102, both the scissors blade base portions 86 and the rockers 94 and 96 resist such relative movement of the scissors blades 80 and 82 away from their stowed positions in the cavities 44 and 52. Once the spring tips 114 and 116 are resting against the cam surfaces 126, 128, however, only friction resists further movement of the handles through a small angle, after which the spring tips 114 of the scissors blade springs 104 encounter the flat detent surface 129 on the base portion 86 of each of the scissors blades 80 and 82. Each flat detent surface 129 is oriented approximately perpendicular to the length of the respective scissors blade 80 or 82, and acts together with the respective scissors blade spring tip 114 as a detent to hold the respective handle 34 or 36 stable with respect to the scissors blade 80 or 82, in a position similar to that of the handle 36 as shown in FIG. 8. This position improves the ease and safety of gaining access to the tool bits stowed in the particular handle, such as the screwdriver and cap lifter 46, the flat Phillips screwdriver 48, and the tweezers 50, in the handle 36. When both handles 34 and 36 are similarly positioned the respective detents hold the two handles in line with each other so that a scale 131 inscribed on the handles can be used for measurements up to the combined lengths of the two handles 34 and 36.

Figure 9:
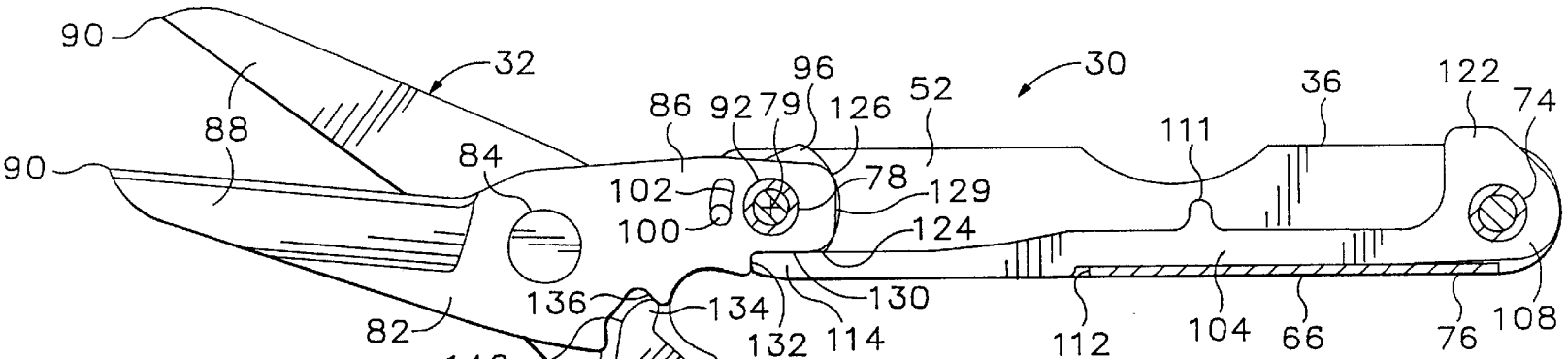
FIG. 9 is a sectional view of the same portion of the tool as shown in FIG. 7, showing both handles extended with the scissors blades of the multipurpose tool in their deployed, open positions, ready for use.

Moving each handle 34 or 36 further in the same direction with respect to the attached scissors blade 80 or 82 brings the respective scissors blade spring tip 114 onto the flat surface 130 on each base portion 86, and the force of each scissors blade spring 104 then urges the respective scissors blade to rotate toward the deployed position shown in FIGS. 1 and 9.

When a scissors blade 80 or 82 is in the deployed position the respective spring tip 114 of the scissors blade spring 104 rests against a handle extension stop 132 which then prevents the handle from moving further with respect to the scissors blade base portion 86. As a result, when both of the blades 80, 82 are deployed, with the handles 34, 36 fully extended as shown in FIG. 9, the scissors blade springs 104 and rocker springs 106 face toward each other. Movement of the handles 34, 36 toward each other then results in movement of the cutting portions 88 of the scissors blades toward each other in a scissors blade closing direction.

Each of the rockers 94, 96 includes a finger-like outer end 134 which rests against a cam surface 136 of the base portion 86 of the opposite scissors blade. Thus the outer end 134 of the rocker 94 rests against the cam surface 136 of the base portion 86 of the scissors blade 82 as shown in FIGS. 1 and 9. Since the cam lobe 124 of the rocker 94 rests against the rocker spring 106 associated with the handle 34, movement of the handles 34, 36 toward one another is resisted by the force of the spring 106 as the cam face 136 moves into contact with the outer end 134 of the rocker 94 and moves it in a counterclockwise direction about the scissors pivot pin 78 of the handle 34. As the handles 34, 36 are moved toward each other to move the cutting portions 88 toward each other in a cutting motion of the scissors blades 80, 82 about the scissors pivot joint 84, the rocker springs 106 oppose further movement in such a scissors-closing direction. However, because of the size of the slot 102 or equivalent opening defined in the base portion 86 of the blade 80, the rocker 94 is free to move counter-clockwise about the scissors pivot pin 78 with respect to the scissors blade 80, except as such movement is opposed by the rocker spring 106 of the handle 34.

As the outer end 134 moves along the cam surface 136 toward the scissors pivot joint 84, the lever arm lengths about the scissors pivot pin 78 and the scissors pivot joint 84 change. The force required to continue to move the handles 34, 36 toward each other thus increases less than the force exerted by the spring 106 increases, and the force on the handles 34 required for closing the cutting portions 88 of the scissors blades does not increase unpleasantly during a complete cutting stroke of the scissors 2.

Figure 10:
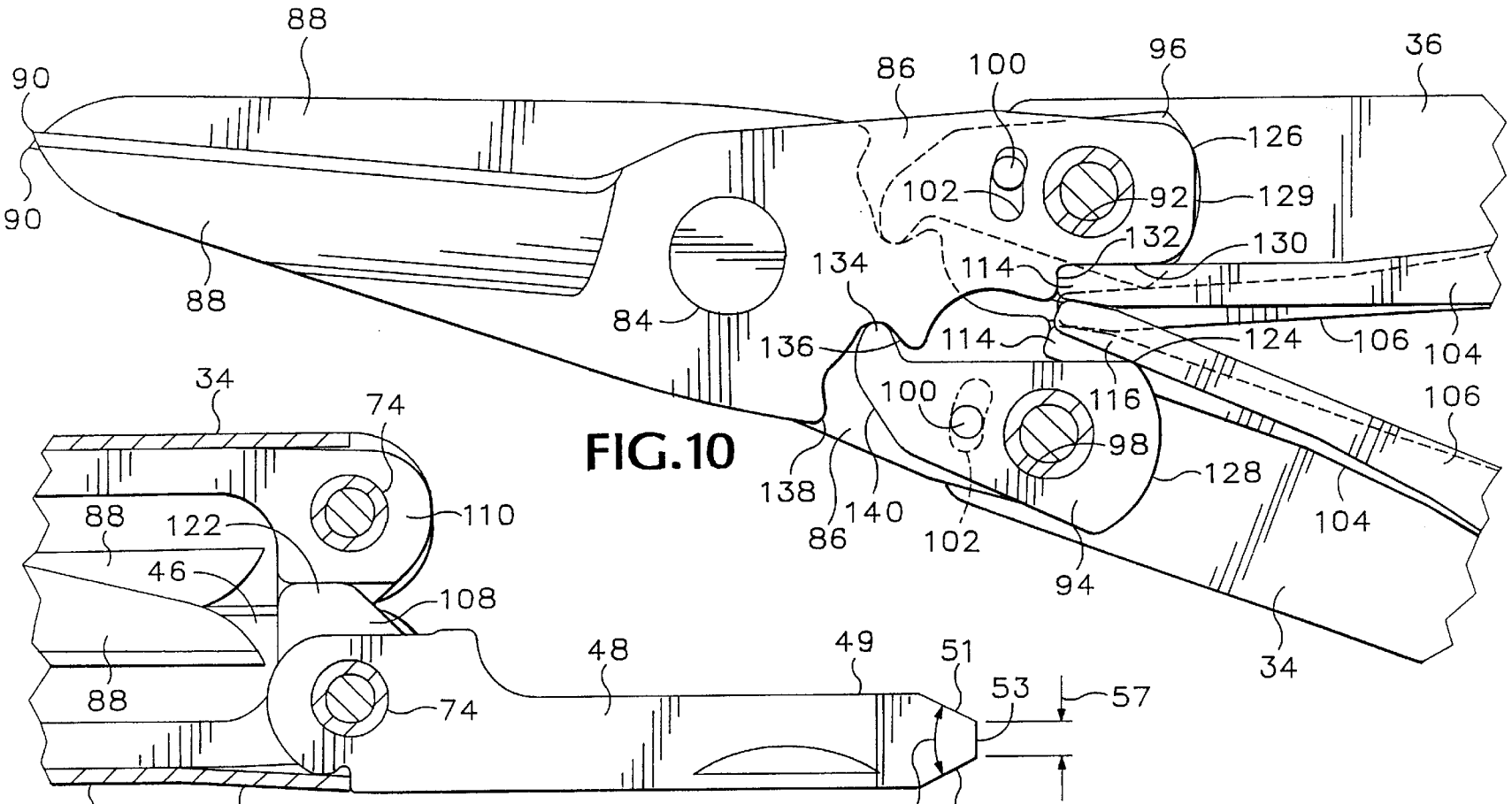
FIG. 10 is a sectional view, similar to that of FIG. 9, of a detail of the scissors and a portion of each of the handles of the tool with the scissors blades in their fully closed position.

Referring now to FIG. 10, when the cutting portions 88 of the scissors blades have completed a cutting stroke the blade tips 90 are barely past one another. Rotation of the rockers 94, 96 has then flexed each rocker spring 106 so that its tip 116 is displaced toward the facing spring tip 114 of the scissors spring 104 of the opposite handle. Each spring tip 116 is thereby moved into contact with the spring tip 114 in the opposite one of the handles 34 and 36 preventing further movement of the handles 34, 36 toward each other, completing a cutting or blade-closing stroke of the scissors 32.

When pressure on the handles 34, 36 is released, the potential energy stored in the rocker springs 106 moves the rockers 94, 96. The outer ends 134 act upon the cam surfaces 136 of the opposite base portions 86, so that the rocker springs 106 open the cutting portions 88 of the scissors blades in preparation for a subsequent cutting stroke.

Figure 11:
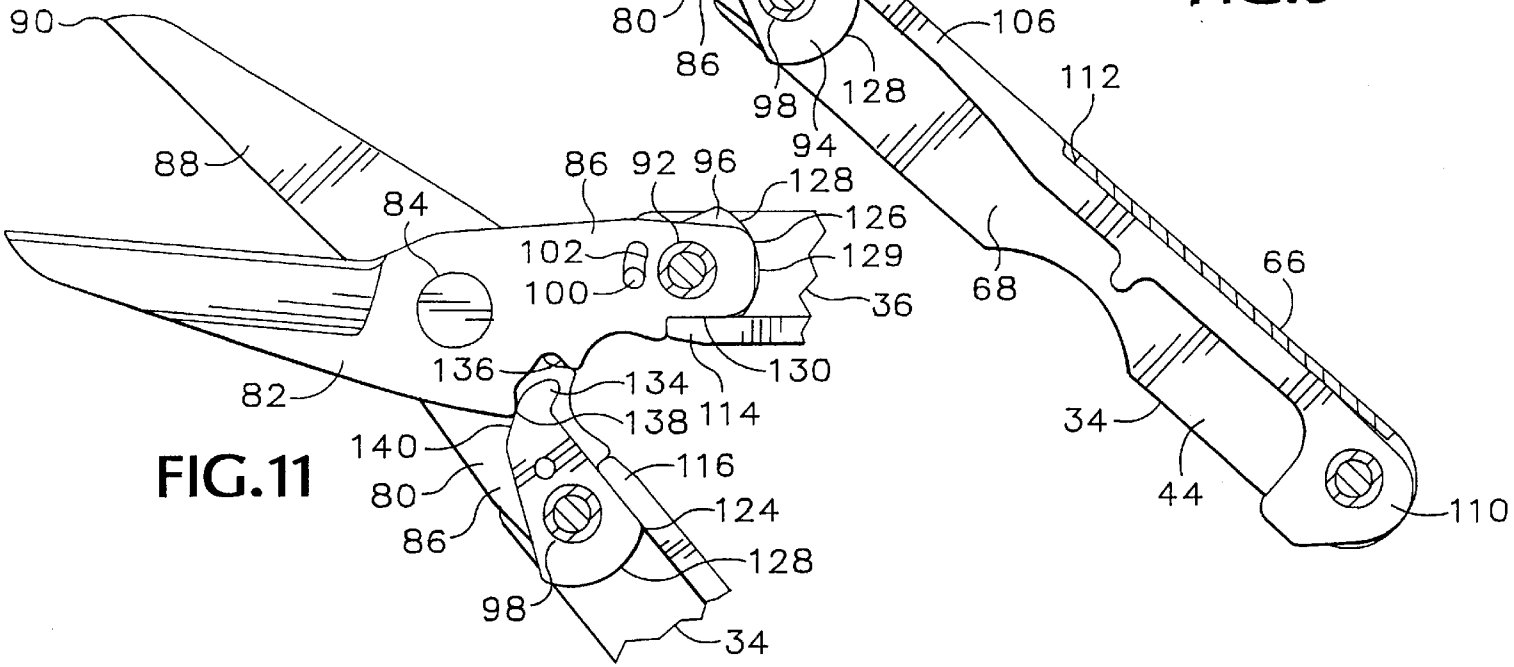
FIG. 11 is a sectional detail view of the same portion of the tool shown in FIG. 9, showing the scissors blades opened to their maximum separation.

The scissors blades are prevented from opening beyond a desired position where the edges of the cutting portions 88 are still registered with one another ready to cut material, by a scissors opening stop 138 included in the base portion 86 of each of the scissors blades. The scissors opening stop 138 encounters an outer face 140 of the rocker, as shown in FIG. 11, rotating the rocker 94 clockwise and the rocker 96 counterclockwise, as shown, until the pin 100 engages the interior of the slot 102 into which it extends and thereby is prevented from rotating further with respect to the base portion 86 of the scissors blade interconnected with the one of the handles on which the particular rocker is located.

When it is desired to return the tool 30 to its folded configuration with the scissors blades 80, 82 in their stowed position within the cavities 44, 52, it is necessary simply to move the handles 34, 36 away from each other beyond the position where the scissors blades are prevented from opening further. The scissors blade springs 104 and rocker springs 106 are thereby flexed as their tips 114, 116 again encounter the cam faces and flats 126, 128. When the spring tips 114, 116 begin to ride off the cam surfaces 126, 128 they again act against the flat surfaces 118 of the base portions 86 and the flat surfaces 120 of the rockers 94, 96 to urge the handles 34, 36 to spring toward one another into the folded configuration as described previously.

As the handles 34, 36 are moved toward their respective folded positions, hump 111 of the respective rocker spring 106 approaches the outer margin 125 of each of the blades 80, 82. If the tool bit ends of the handles move closer toward each other than the separation between the scissors ends of the two handles at that time the hump 111 causes the scissors blades 80 and 82 to rotate about the scissors pivot joint 84 toward the crossing configuration, thus bringing the scissors pivot pins 78 and the scissors ends of the handles closer together. As a result, the tool moves smoothly into the folded configuration regardless of where pressure is applied along the length of each handle 34 or 36.

Figure 12:
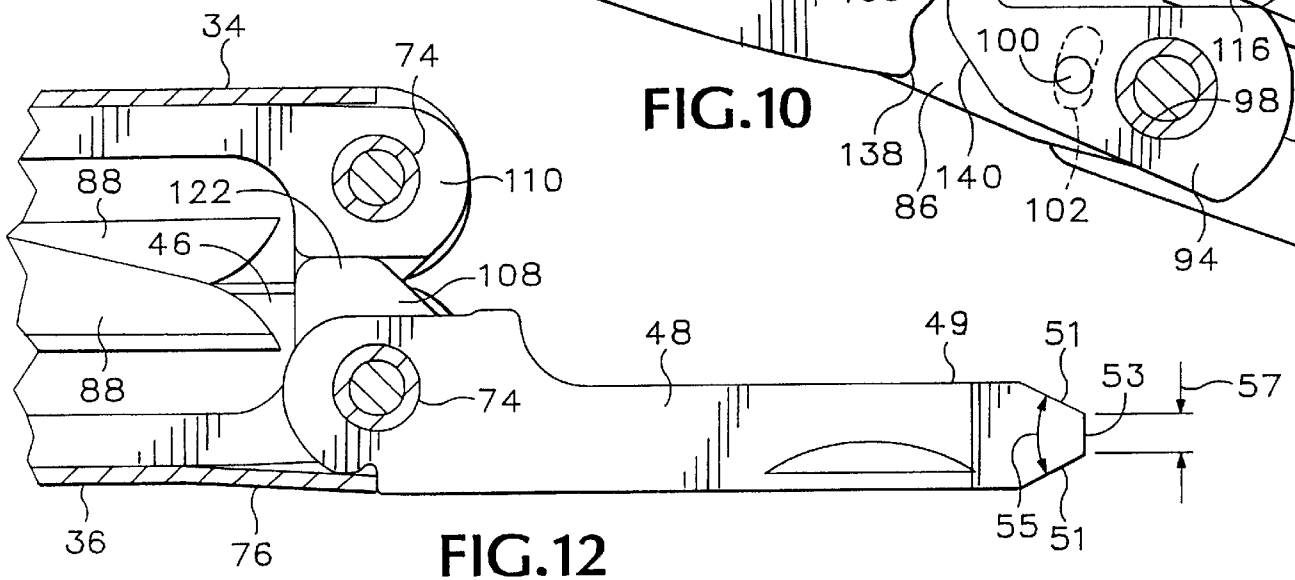
FIG. 12 is a sectional view of a portion of the tool bit end of the multipurpose tool, taken in the direction of line 12—12 in FIG. 4, showing the flat Phillips screwdriver blade in its deployed position.

With the appropriate one of the handles 34 or 36 moved to a position such as that of the handle 36 as shown in FIG. 8, a desired one of the additional tool blades can be rotated into an extended position such as the position of the flat Phillips screwdriver blade 48 as shown in FIG. 12. The handles 34, 36 can then be returned to the closed configuration with respect to each other while the extended tool blade is held in place by the action of the leaf spring 76 against a base portion of the tool blade in the manner well-known in folding knives. With the handles 34, 36 held close together by the action of the scissors blade springs 104 and rocker springs 106, and with the ears 122 of the scissors blade springs and the cam lobes 124 of the rockers 94, 96 extending into spaces provided alongside each other in the opposite handles as explained previously, the handles 34, 36 are held in place with respect to each other, allowing screwdriver blades to be used without the handles 34, 36 being displaced laterally from each other by the twisting force used.

The above-described arrangement for holding a folding tool incorporating the scissors blades 80, 82 in a folded configuration and for urging the blades 80, 82 open when they are in their deployed position with respect to the handles may also be used for operation of tools such as pliers or special grasping tools, not shown, which include a pair of relatively movable interconnected members such as jaws or jawlike members which pivot with respect to each other about a jaw pivot joint corresponding to the scissors pivot joint 84. Such jaws or jawlike members include acting portions corresponding to the cutting portions 88 of the scissors blades 80, 82, and an arrangement of springs, which may be referred to in such devices as jaw springs, corresponding to the scissors blade springs 104, would act upon base portions of the jaws or jawlike members of such a tool. Similarly, such a tool would include rockers such as the rockers 94, 96 linked with the base portion of such jawlike members and interacting with such jawlike members to limit their movement appropriately and to assist in keeping the folding tool including such jaws or jawlike members securely in its folded configuration.

In order to make the folding tool 30 as compact as possible yet have a Phillips screw driving capability, the flat Phillips screwdriver blade 48 is generally planar, rather than having a cruciform driving end. The blade 48 tapers similar to the flutes of a Phillips screwdriver from a maximum thickness at 49, beyond the angled faces 51, to a minimum thickness of 0.022 inch at the transverse end face 53. The angled faces 51 form an included angle 55 of 53°, corresponding to the shape of a Phillips head screw socket, and the transverse end face 53 preferably has a width 57 of 0.074 inch, which is narrow enough to fit into the socket of most Phillips screws intended to accept a No. 1 Phillips screwdriver. However, because the flat Phillips screwdriver blade 48 lacks a pointed end, and is thus wider at its transverse end face 53 than a normal Phillips screwdriver, it fits drivingly in the socket of a Phillips screw intended to be driven by a No. 2 Phillips screwdriver. The flat Phillips screwdriver blade 48, then, although generally planar, can be used to function in place of either a No. 1 or a No. 2 Phillips screwdriver.

Figure 6:
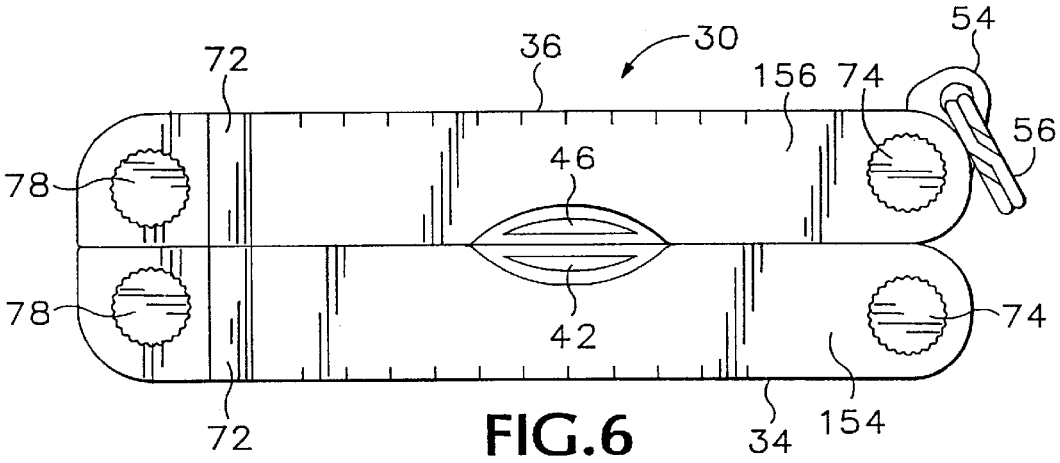
FIG. 6 is a right side view of the multipurpose tool shown in FIG. 1, in the folded configuration shown in FIG. 2.
Figure 13:
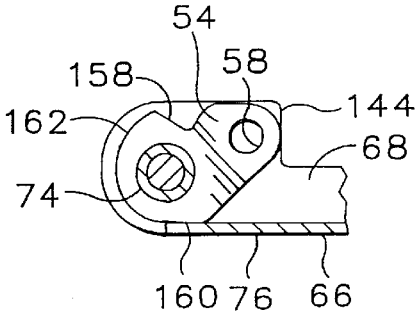
FIG. 13 is a sectional view of a portion of one of the handles of the tool, taken in the direction of line 13—13 of FIG. 4, showing the lanyard attachment eye in a pocket-carried configuration of the tool.

An opening 144 is defined in one of the side walls 68 of the handle 36, and the tweezers 50, which include a base portion 146 and a pair of legs 148, are stowed generally within the cavity 52, alongside the flat Phillips screwdriver 48. Each of the legs 148 has a length extending parallel with the handle 36 as shown in FIG. 6, a thickness 150, and a width 152, indicated in FIG. 5, so that as shown herein an outer side face 154 of each leg 148 is located generally flush with an outer face 156 of the side wall 68 defining the opening 144. The provision of the opening 144 permits the width 152 of each tweezers leg 148 to be greater than would otherwise be possible given the overall size of the handle 36, and it also permits each tweezers leg 148 to have an even greater width 152 where it is acceptable for the outer side faces 154 to protrude beyond the outer face 156.

The tweezers 50 may be made by cutting a flat sheet of metal to include the base 146 and legs 148, and then folding the legs 148 upward to bring the legs 148 perpendicular to the base 146 with the outer side faces 154 in a single plane. The legs 148 are thus thinner than they are wide and are oriented with their width generally perpendicular to the plane of the base portion 146.

The lanyard ear 54 is mounted rotatably on the same tool pivot shaft 74 on which the base portion 146 of the tweezers 50 is located. The lanyard attachment ear 54 is located between the base portion 146 of the tweezers 50 and the nearer side wall 68, acting there as a spacer to locate the base portion 146 of the tweezers axially along the tool pivot shaft 74 on which both are located for rotation. The lanyard attachment ear 54 is movable selectively in the direction of the arrow 60, between the position shown in FIG. 2 and that shown in FIG. 13, which requires prior removal of the split ring 56 from the hole 58. In either of the positions described, the leaf spring 76 in its normal relaxed position extends along one of the two flat surfaces 158 and 160. Movement of the lanyard attachment ear 54 between the two positions, however, results in a cam surface 162 between the two flat surfaces 158 and 160 being brought to bear against the leaf spring 76, which opposes such movement. Thus, the lanyard attachment ear 54 is held stably in the position shown in FIG. 13, resulting in the exterior surface configuration of the folding tool 30 being generally smooth and unlikely to cause excessive wear in a pocket of a person's clothing as a result of carrying the tool 30.

Figure 14:
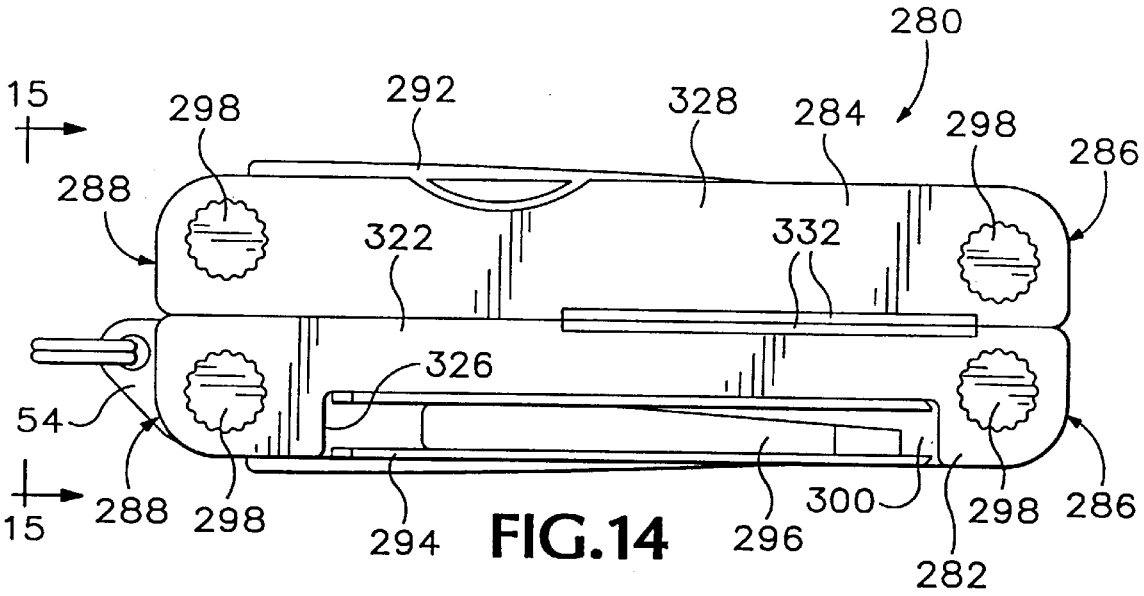
FIG. 14 is a side elevational view of a multipurpose folding tool which is another embodiment of the present invention.
Figure 16:
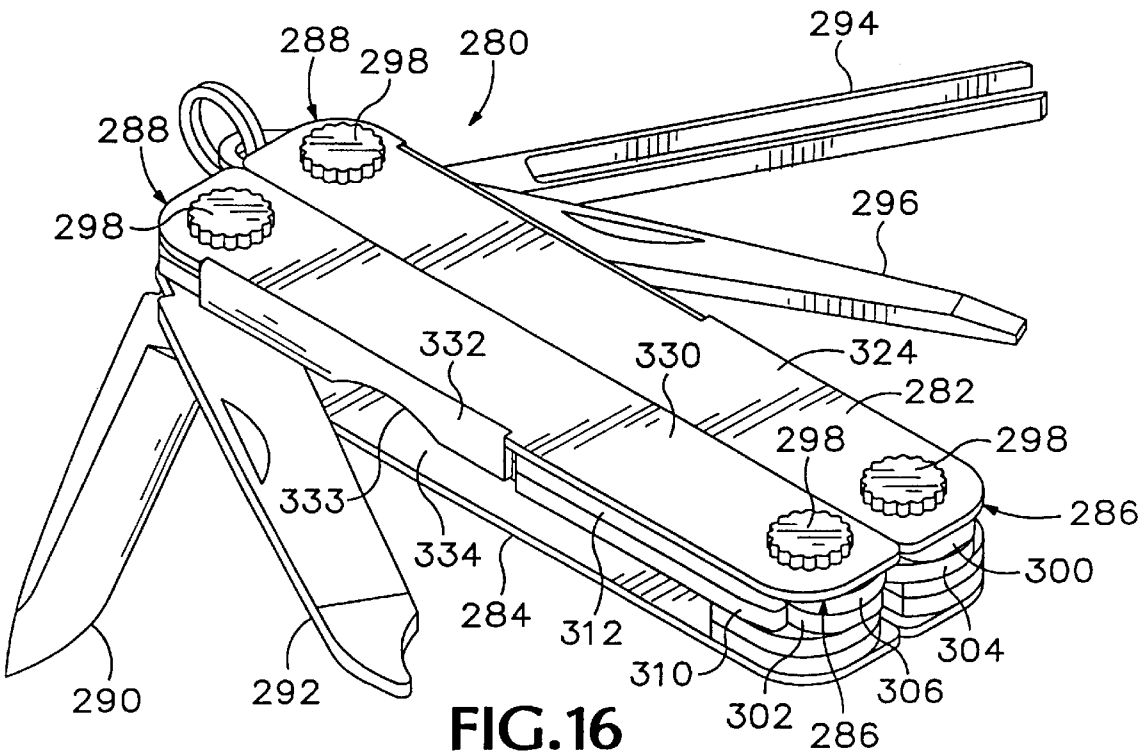
FIG. 16 is a perspective view of the multipurpose tool shown in FIG. 14, with several tool blades partially unfolded.
Figure 15:
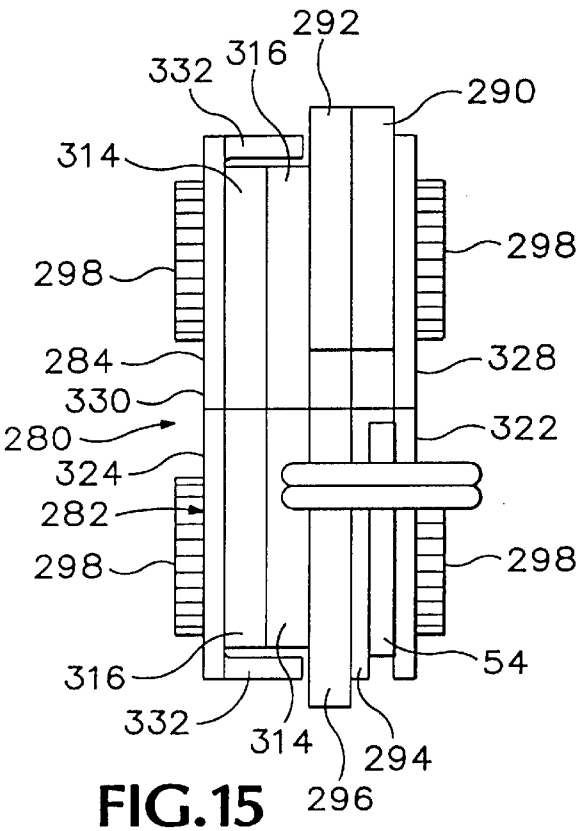
FIG. 15 is an end view of the tool shown in FIG. 14, taken along line 15—15.

Turning now to FIGS. 14–16, a folding multipurpose tool 280, shown in a folded configuration in FIG. 14, includes a pair of handles, a first handle 282 and a second handle 284, each having a scissors blade, or inner, end 286 and an opposite outer end 288. The multipurpose tool 280 includes several separate tool blades or bits, including a knife blade 290 and a fingernail tool 292 located within the second handle 284, and a pair of tweezers 294 and a small screwdriver 296 located within the first handle 282, with a lanyard ear 54 alongside the tweezers 294. The several separate tool blades or bits 290, 292, 294, and 296 are individually available to be moved outward from their respective stowed positions while the two handles 282 and 284 remain alongside each other in the folded configuration of the multipurpose tool 280 as shown in FIGS. 14 and 15. Referring to FIG. 16, where the separate tool blades are shown in partially opened positions, each of the separate blades 290, 292, 294, and 296 defines a respective pivot hole and is attached to the respective handle 282 or 284 by one of a pair of pivot shafts 298 each located at the outer end 288 of the respective one of the handles 282, 284. The pivot shafts 298 may be of the same construction as the tool pivot shafts 74 described above.

A pair of scissors 299 includes blades 300 and 302 and a pair of rockers 304 and 306 similar, respectively, to the scissors blades 80 and 82 and the rockers 94 and 96 of the folding scissors 32 described previously, and the scissors blades 300 and 302 are interconnected by a pivot joint 308 which corresponds with the joint 84 described previously. The scissors blades 300, 302 and rockers 304, 306 are pivotally carried on respective pivot shafts 298 located at the scissors blade or inner end 286 of each of handles 282, 284.

Associated with each scissors blade 300 or 302 is a respective scissors blade spring 310 which may be identical with the scissors blade springs 104 described previously. Alongside each scissors blade spring 310 is an identical rocker spring 312. An anchoring end 314 of each scissors blade spring 310 and an anchoring end 316 of each rocker spring 312 include apertures which fit snugly on the pivot shaft 298 at the outer end 288 of the respective handle 282 or 284.

A pair of tool bit springs 318, each having an anchoring end 320 and an opposite outer end 321, are also identical to the scissors blade springs 310, and are located in the handles 282, 284, but extend in the opposite direction from the scissors blade springs 310 and rocker springs 312. The anchoring ends 320 thus are fitted snugly on the pivot shafts 298 located at the scissors blade, or inner, ends 286 of the handles 282 and 284. The spring 318 for each tool blade or bit thus also serves as a spacer for that tool blade or bit at the opposite end of the handle.

The handles 282 and 284 are similar but not identical with each other. The handle 282 consists basically of the two pivot shafts 298 located respectively at the inner and outer ends 286 and 288, and a first handle side 322 and a second handle side 324 which are similar to each other, except for a nail cutout 333 and a cutout 326 defined in the first handle side 322, to accommodate the tweezers 294 in its stowed position, and different radii of curvature of the corners. The second handle 284 differs in that a first handle side 328 and a second handle side 330 are both generally symmetrically opposite, or mirror images of, the second handle side 324 of the first handle 282 and are identical with each other except for the radii of curvature of the corners. Preferably, the shapes of the anchoring ends 314, 316 and 320 of the springs are similar to the shape of each of the opposite ends of the handle sides 322, 324, 328 and 330, as may be seen in FIGS. 16 and 17, to present a fairly smooth configuration of the multipurpose tool 280 when it is in its fully folded configuration as shown in FIG. 14.

Each of the handle sides 322, 324, 328, and 330 includes a flange 332, formed as an integral part of the respective handle side, extending longitudinally along the back margin of the handle side, directed perpendicularly away from it and thus directed toward the other one of the pair of handle sides of the respective handle 282 or 284 of which it is a part. The handle sides 322, 324, 328 and 330 thus have an L shape, including the flange 332 as the bottom leg of the L. The flanges 332 may include a small crescent-shaped cutout 333 to give better access to the tool bits. Each handle side is preferably made by cutting a piece of sheet metal to shape, and then forming a groove and bending the flange 332 in the appropriate direction to a position perpendicular to the plane of the respective handle side. Each of the handles 282 and 284 defines a respective cavity 334 between its first handle side 322 or 328 and its second handle side 324 or 330, and each flange 332 has an inner surface 336 and an outer surface 338.

Each of the scissors blade springs 310, rocker springs 312, and tool bit springs 318 includes a shoulder 340 defining an end of a surface 342 that extends toward the anchoring end 320 and faces toward the inner surface 336 of the adjacent flange 332. A back surface 344 of the outer end portion of each of the scissors blade springs 310, rocker springs 312, and tool bit springs 318 extends away from the shoulder 340, and is aligned with the outer surface 338 of the flange 332. The outer end or tip of each of the scissors blade springs 310 rests against the base of the respective scissors blade and the tip of each rocker spring 312 rests on a surface of the respective rocker with a force generated by elastic bending of the respective spring 310 or 312, and, to a lesser degree, by elastic bending of the anchoring end portion thereof, with the respective flange 332 supporting each of the springs along its surface 342, and particularly the portion of the surface 342 adjacent the shoulder 340 of each of the springs, while the adjacent handle sides and adjacent tool bit spring anchoring ends 320 keep the scissors blade springs 310 and rocker springs 312 laterally aligned. The number of blades or bits a handle may contain is limited only by the width of the flange 332 (the length of the "L" leg) and the thickness of the tool bits and springs.

Figure 17:
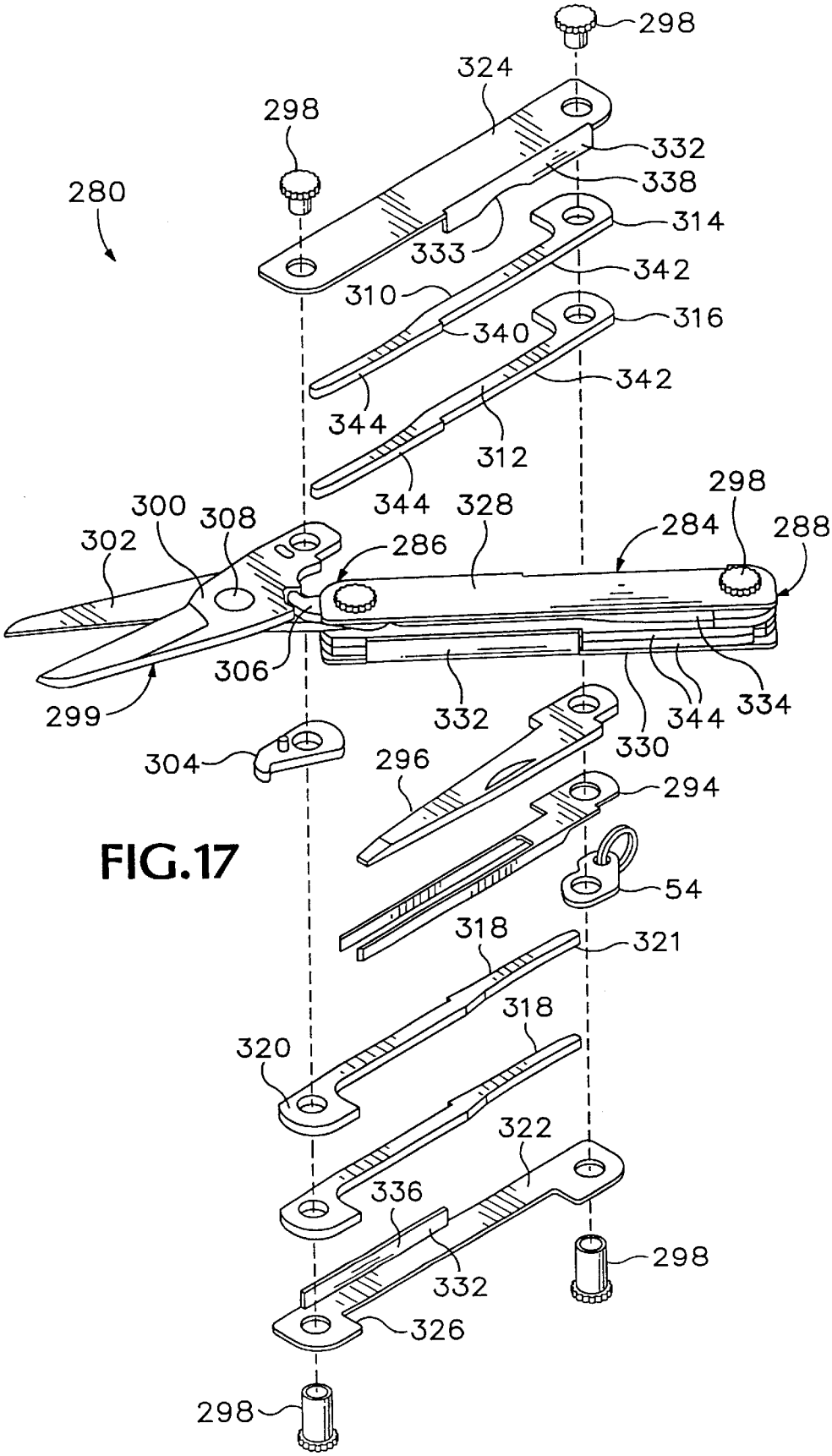
FIG. 17 is a perspective view of the tool shown in FIGS. 14, 15 and 16, with an included pair of scissors deployed, and with one handle and the associated tool blades shown in exploded view.

The respective flanges 332 of the first handle side 322 and first handle side 328 are adjacent to and lie against each other with their outer surfaces 338 in contact with each other at the inner or scissors blade end 286 of each of the handles when the tool 280 is folded, as shown in FIG. 14. The flanges 332 of the second handle sides 324 and 330, however, are located adjacent the outer ends 288 of the respective handles 282, 284 and are located on the sides of the handles 282, 284 which are remote from each other when the tool 280 is in the folded configuration as shown in FIGS. 14 and 15. The flanges 332 of the second handle sides 324 and 330, on the other hand, face toward each other when the handles 282, 284 are extended to deploy the scissors 299, as shown in FIG. 17. This orientation of the first handle side 322 and first handle side 328 provides for the tool bit springs 318 to have their outer or free ends in contact with respective flat surfaces of the base of each of the tool bits or blades 290, 292, 294, and 296 to retain each of them stably in either a closed configuration as shown in FIG. 14 or a fully open position (not shown), similar to the retention of each of the scissors blades as explained above with respect to the scissors 30, and operation of the scissors 299 is substantially the same as operation of the scissors 32.

The separate first handle sides 322 and 328 and second handle sides 324 and 330 of the handles 282, 284 permit the handles 282, 284 to be assembled by stacking the several tool bits, rockers, and springs, as well as the handle sides, on the respective pivot shafts 298, as shown most clearly in the exploded portion of FIG. 17, allowing each of the several tool bits and springs to be put into place individually on the respective pivot shafts 298.

Figures 18, 19:
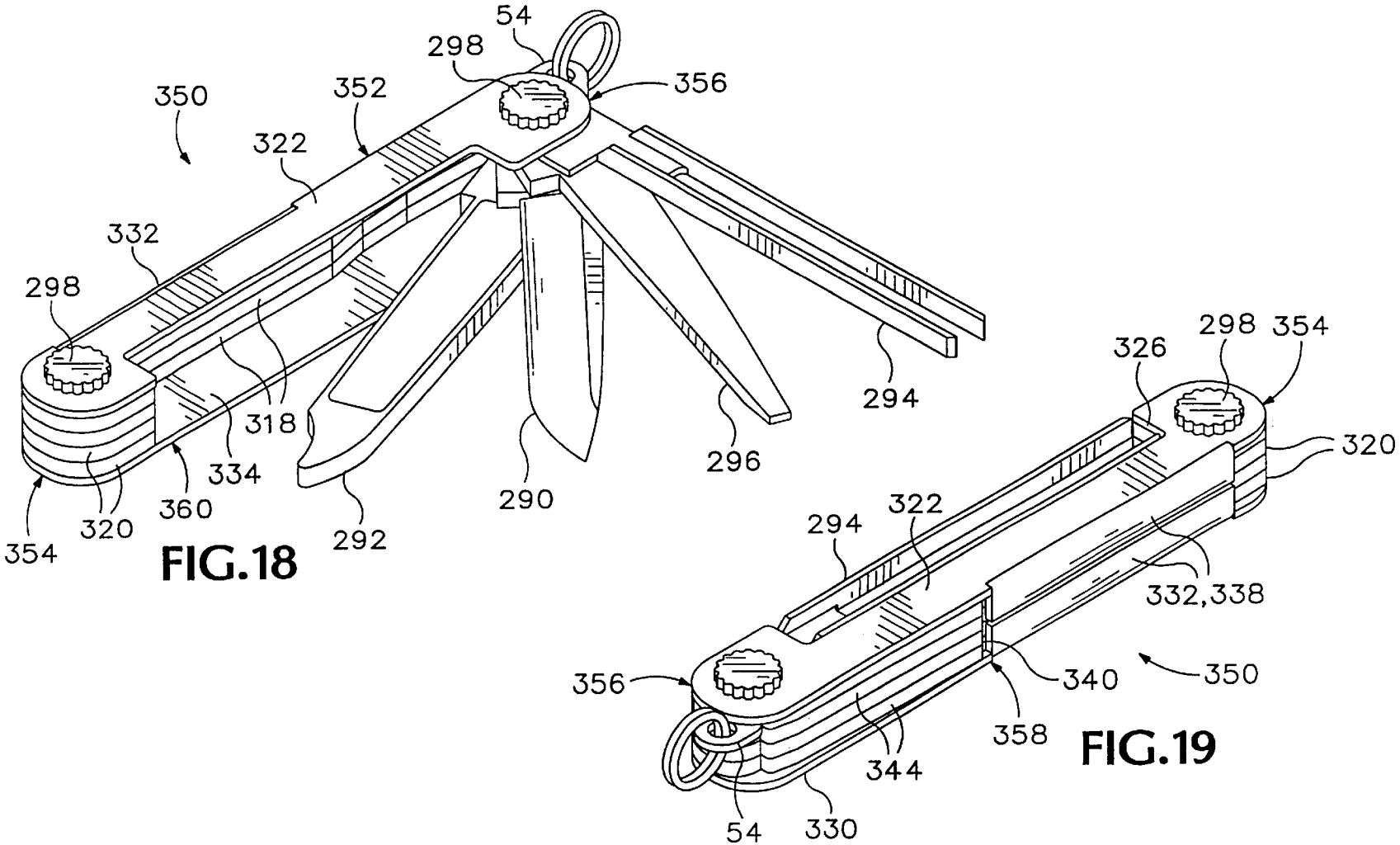
FIG. 18 is a perspective view of a multipurpose folding tool which is yet another embodiment of the present invention, showing its several tool blades partially unfolded.
FIG. 19 is a perspective view of the back side of the multipurpose folding tool shown in FIG. 18, with all of the several tool blades folded.
Figure 20:
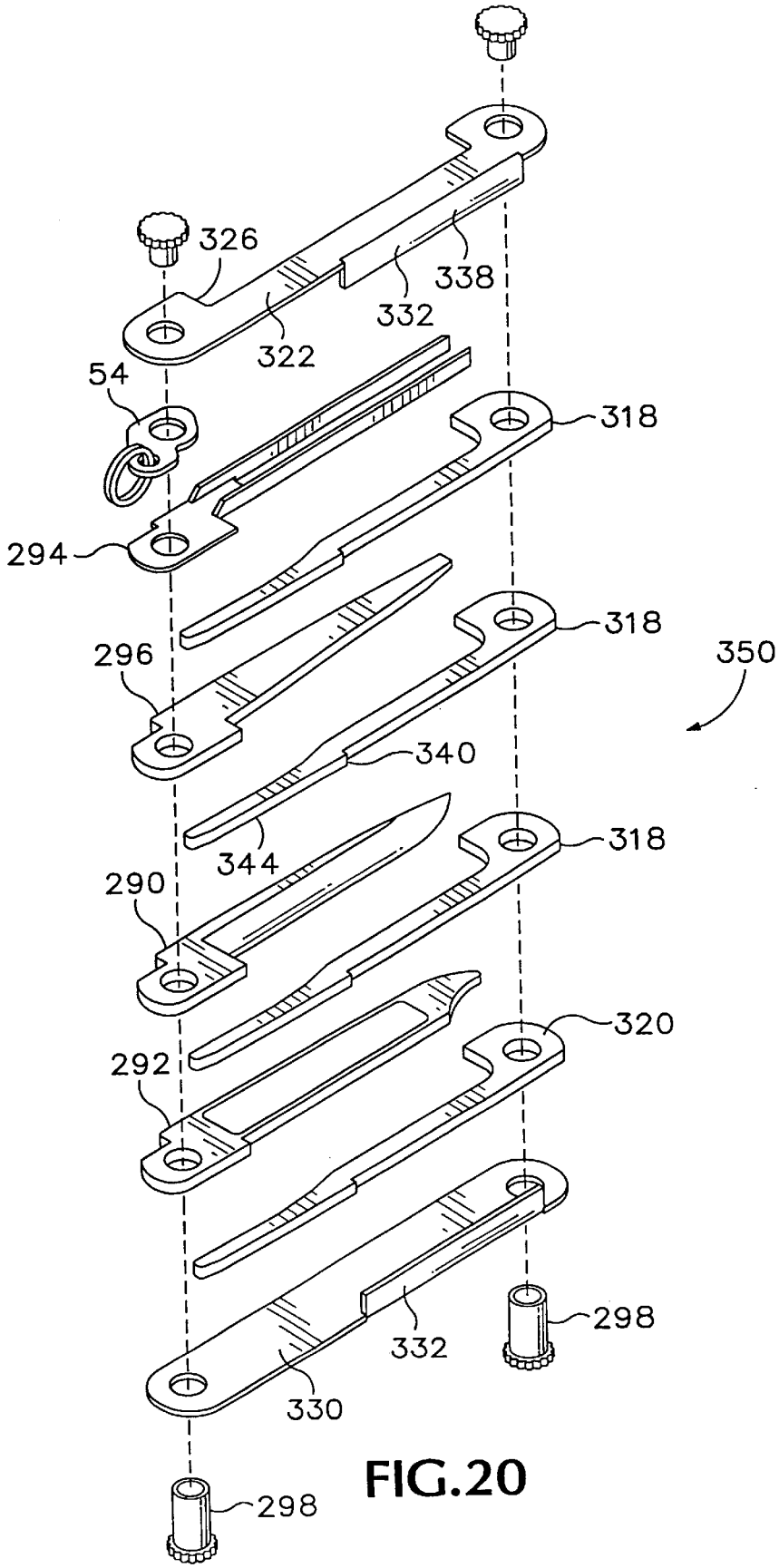
FIG. 20 is an exploded perspective view of the tool shown in FIG. 19.

As shown in FIGS. 18, 19 and 20, a multipurpose tool 350 is assembled of parts similar to those included in the multipurpose tool 280, and has a single handle 352 including a first handle side 322 identical with that of the first handle 282, and a second handle side 330 identical with that of the second handle 284 of the multipurpose tool 280 described above. The first and second handle sides 322 and 330 are interconnected by a pair of pivot shafts 298, and four tool bit springs 318 aligned with each other are located in a cavity defined between the handle sides 322, 330 with their anchoring ends 320 all side-by-side at an outer end 354 of the. handle 352. The bases of several tool blades or bits, the same knife blade 290, fingernail tool 292, tweezers 294, and screwdriver 296 being shown here, are all mounted side-by-side between the first and second handle sides, at the inner end 356 of the handle 352. The flanges 332 of the first and second handle sides 322 and 330 thus are both located adjacent the outer end 354 of the handle 352 and are directed toward each other on the same side, that is, the back side 358 of the handle 352, and each of the tool bits or blades is available individually on the other, or front side 360 of the handle 352.

It will be understood that different tool blades or bits could be included in the multipurpose tool 280 or the multipurpose tool 350, instead of those shown, without departing from the present invention.

Figure 21:
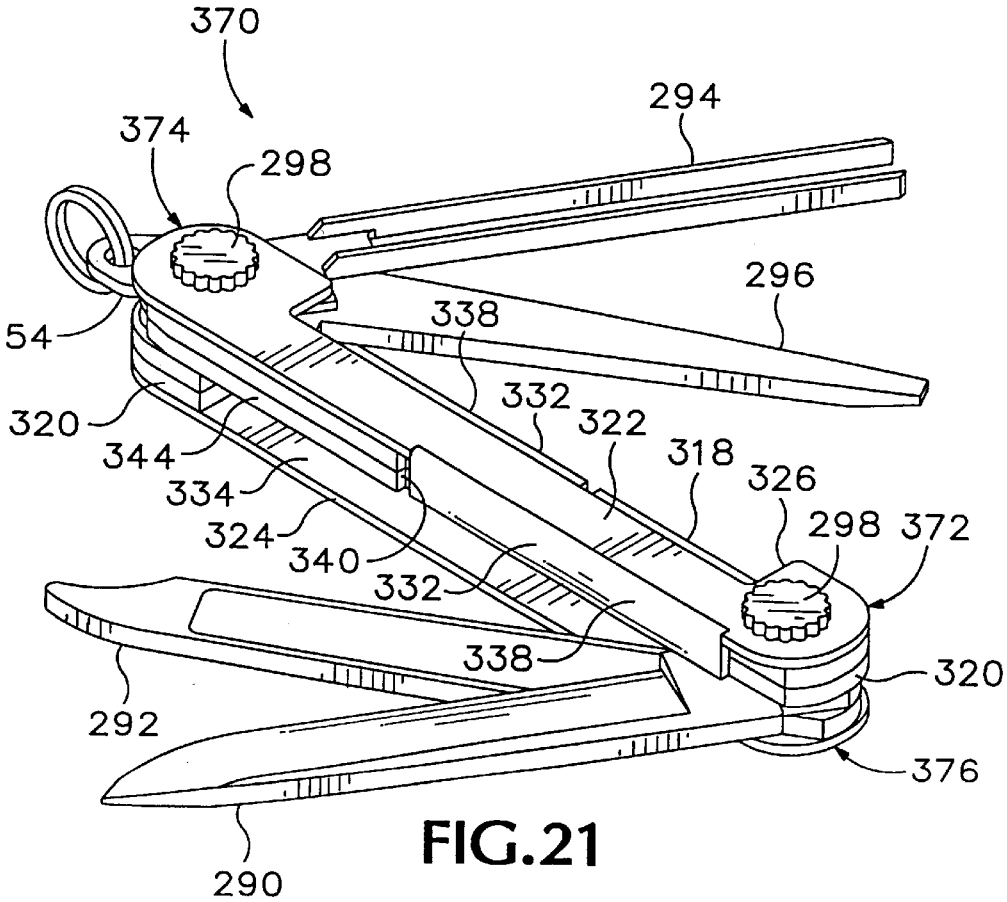
FIG. 21 is a perspective view of a multipurpose folding tool which is yet a further embodiment of the present invention, showing all of its several tool blades partially opened.
Figure 22:
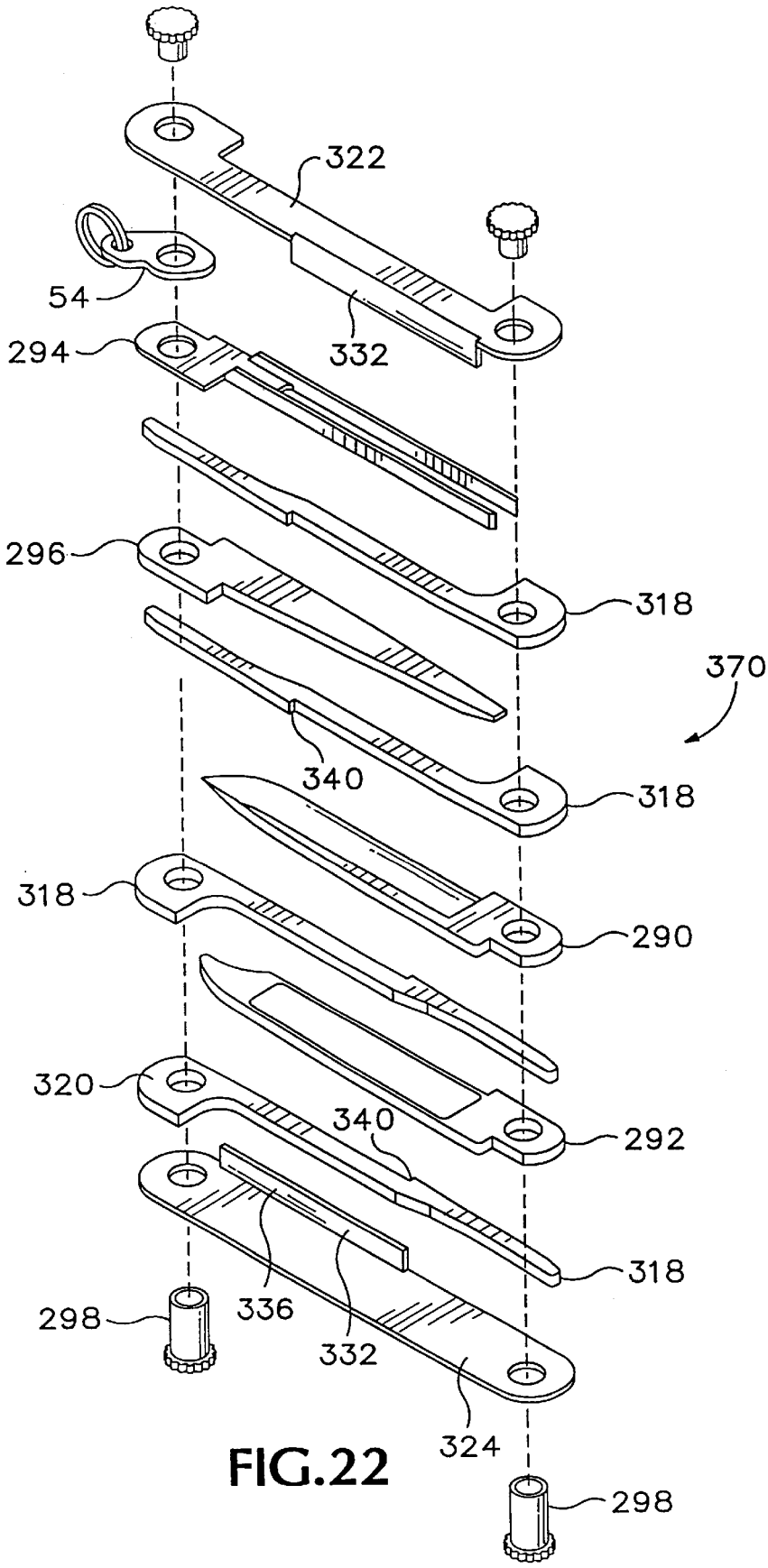
FIG. 22 is an exploded view of the tool shown in FIG. 21, with all of the several tool blades folded.

As shown in FIGS. 21 and 22, a multipurpose tool 370 which is yet another embodiment of the invention has a handle 372 similar to the first handle 282 of the tool 280 described above and includes four tool bit springs 318 located in an arrangement similar to that of the tool bit springs 318, the scissors blades spring 310 and the rocker spring 312 within the first handle 282 of the tool 280. Instead of the scissors blade and rocker of the multipurpose tool 280, however, a knife 290 and a fingernail tool 292 are mounted on the pivot shaft 298 located at a first, or inner end 374, while a pair of tweezers 294 and a small screwdriver 296 are mounted on the pivot shaft 298 located at the other or outer end 376 of the handle 372. The use of the first handle side 322 and second handle side 324 as in the first handle 282 in this arrangement allows the tool 370 to have blades opening from each of the ends 374 and 376 of the tool handle 372.

The use of a pair of handle sides which are identical or which are symmetrically opposite, or mirror images of each other with respect to the location of the flange 332, allows selection of at least four different handle arrangements, as will be understood. In each such handle arrangement, furthermore, the handle construction. in accordance with the present invention is simpler than that of an ordinary jack-knife in which a central pin has traditionally been used to fasten individual blade springs in place, since each tool bit spring 318 is supported by a respective flange 332 near the shoulder 340 and along the surface 342, thus providing for a smaller tool, since the individual springs 318 do not need to be deep enough to define a pin hole adjacent the location of the shoulder 340.

Figures 23, 24, 25, 26, 27:
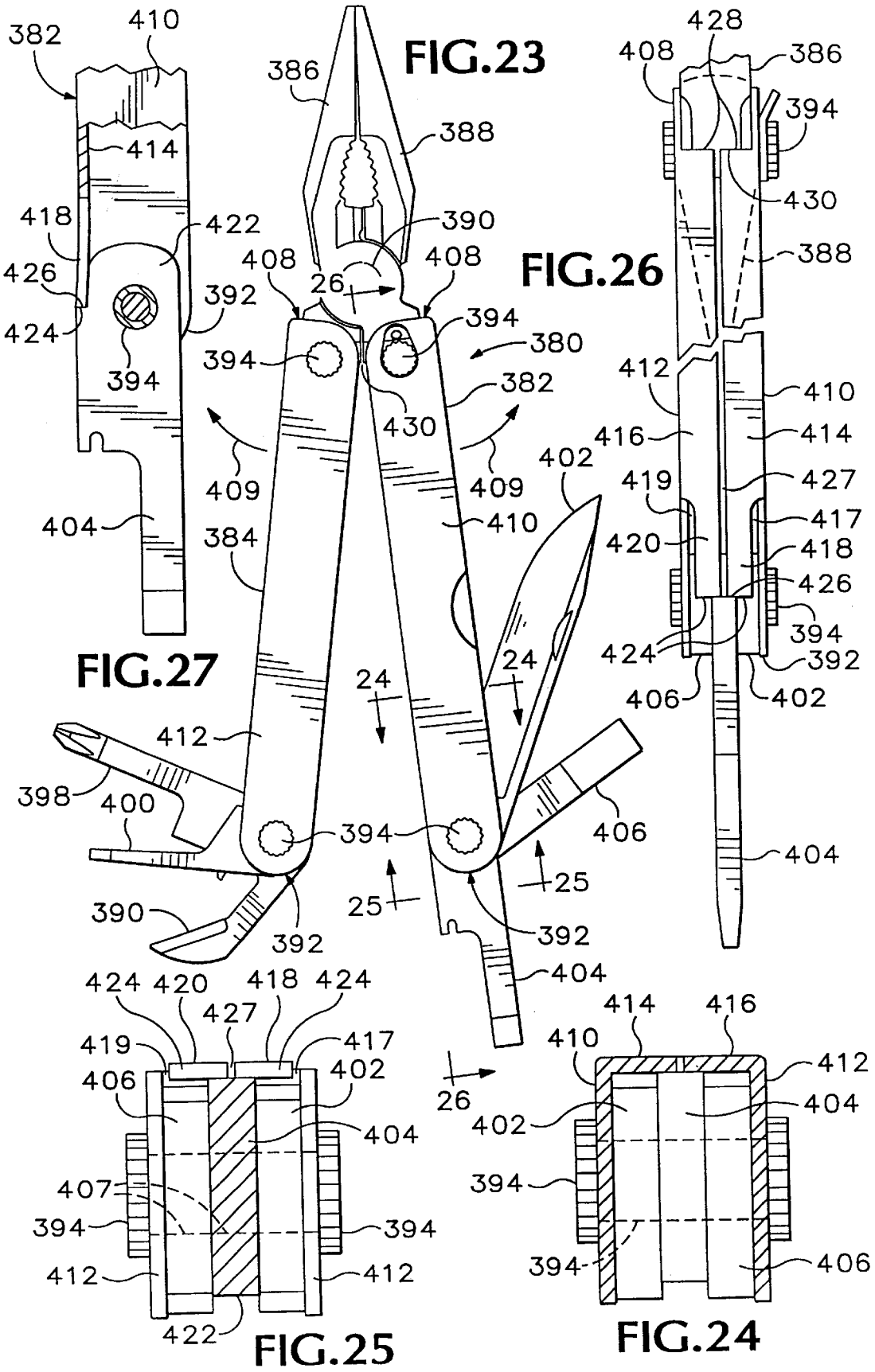
FIG. 23 is a front elevational view of a multipurpose tool which is yet a further embodiment of the present invention, with its several blades partially opened and its pliers deployed.
FIG. 24 is a section view of one handle of the multipurpose tool shown in FIG. 23, taken along line 24—24.
FIG. 25 is a view taken along line 25—25, of the multipurpose tool shown in FIG. 23.
FIG. 26 is a view of one of the handles of the multipurpose tool shown in FIG. 23, taken in the direction indicated by the line 26—26.
FIG. 27 is a partially cutaway fragmentary view of the handle shown in FIG. 26.

A multipurpose tool 380 shown in FIG. 23 includes a pair of elongate handles 382, 384 interconnected respectively with a pair of pliers jaws 386, 388 interconnected with each other by a pivot joint 390. It will be understood that scissors blades (not shown) might replace the pliers jaws 386, 388. A first end 392 of each of the handles 382, 384 has attached thereto and movable about a respective pivot shaft 394, several tool blades or bits such as a can opener 396, a Phillips screwdriver 398, and a small screwdriver 400 housed in the second handle 384, while a knife blade 402, a medium screwdriver 404, shown fully extended, and a large screwdriver 406 are included in the first handle 382. Each of the tool blades or bits has a base portion defining a pivot hole 407.

Each of the handles 382, 384 is movable with respect to the pliers jaws 386, 388, about a respective pivot shaft 394 located at a second end 408 of each of the handles 382, 384, so that with all of the tool blades and bits stowed within the handles 382, 384 and with the handles rotated about the pliers jaws 386, 388 as indicated by the arrows 409, the multipurpose tool 380 assumes a compact form with a generally rectangular cross section, similar to the shape of the tool shown in U.S. Pat. No. 4,238,862, and can be carried safely in one's pocket.

The handles 382 and 384 are practically identical with each other, each having a first handle side 410 and a second handle side 412 both of sheet metal of suitable strength and thickness. Each handle side 410, 412 includes a respective flange 414, 416 as an integral part extending along the length of the handle side and directed perpendicular to it toward the opposite one of the handle sides, so that the two flanges 414, 416 are aligned coplanar with each other, as may be seen best in FIG. 24. Each of the handle sides 410, 412 thus is L-shaped in cross section, as shown in FIG. 24, so that the flanges 414 and 416 strengthen and stiffen the handle sides 410, 412 along their length.

At the first end 392 of each handle, each of the handle sides 410, 412 includes a leaf spring 418, 420, extending longitudinally of the handle from the portion of the flange 414, 416 closest to the first end 392, and defined by respective slits 417 and 419 cut in the material of which the respective handle side 410 or 412 is made. The leaf springs 418, 420 extend in line with the flanges 414, 416 when relaxed and are urged slightly outward by a peripheral surface of a base portion of one of the several blades or tool bits, such as the base 422 of the medium screwdriver 404 as shown in FIG. 27, when such a tool blade is extended. As shown in FIG. 27, an end surface 424 of each of the springs rests against an abutment surface such as the surface 426 defined on the base 422 of the medium screwdriver 404 when such a blade is in a fully open or extended position. Preferably there is a small space 427 between the flanges 414 and 416, and thus between the springs 418 and 420, to allow them to flex independently when in contact with a surface of the base of one of the knife or tool blades such as the knife blade 402 or the medium screwdriver 406, although both of the springs 418 and 420 together rest against the base of the medium screwdriver 404, as may be seen in FIG. 25, where the screwdriver 404 is cut away for clarity. Pressure of the springs 418, 420 against the surface of the base of one of the blades or tools helps to retain the blade or tool in either its folded position within the handle 382 or 384, or in its extended position as exemplified by the position of the medium screwdriver 404 in FIGS. 26 and 27.

At the second end 408 of the handles 382, 384 an end surface 428 on each of the flanges 414, 416 is in contact with a shoulder 430 defined on the base of each of the pliers jaws 386, 388 so that movement of the handles 382, 384 toward each other when the pliers are deployed as shown in FIG. 23 urges the tips of the jaws 386, 388 toward each other. The flanges 414, 416 thus extend over the full length of the handle sides 410, 412, to the ends 392 and 408, except as limited by the required locations of the springs 418, 420 and the end surfaces 428.

The handle sides 410, 412 of each of the handles 382, 384 are held together by the pivot shafts 394 located at each end 392, 408. The pivot shafts 394 are preferably similar in type to the pivot shafts 74 described previously, and are tightened to provide the required amount of friction against the sides of the pliers jaws 386 and 388 and against the bases of the tool blades or bits located side-by-side at the first end 392 of each handle.

The use of the two L-shaped handle sides 410, 412 in construction of the handles 382, 384, makes it easier to assemble the tool, since the pliers jaws and individual blades and tool bits can simply be placed one at a time upon the pivot shafts 394. The proper amount of tension in each pivot shaft 394 may be applied easily without having to distort the shape of a formed channel of sheet metal, although the channel shape is still available for stowage of the several blades and tool bits, and the space 427 may be very small, resulting in exclusion of most, if not all, dirt from within the tool in its folded configuration. Since the pair of L-shaped handle sides 410, 412 when assembled are not as rigid as a channel of the same material, however, it is preferable for each of the handle sides 410, 412 to be made of material of a slightly greater strength or thickness than would be needed for a handle of channel form such as that described in the previously-mentioned U.S. Pat. No. 4,238,862.

This construction results in a multipurpose tool 380 which is of equal strength, but much simpler to assemble than previously known multipurpose tools of this type, and which provides the greater security of having more than one spring at the first end of each handle to help to retain individual ones of the several blades or tool bits, either in a folded, stowed, position or in an extended position. It will also be understood that the advantageous simplification of assembly would be available if the flanges 414, 416 were of different widths or of mating interrupted shapes, rather than extending over the full length of the handles 382, 384, but such construction would result in reduced stiffness of the handles 382, 384 and thus is not as desirable for use with the pliers jaws 386, 388.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A folding multipurpose tool, comprising:

(a) a handle having a pair of opposite first and second ends;

(b) said handle including first and second elongate handle sides, said first and second handle sides being aligned with and located opposite each other;

(c) a tool blade having a base defining a pivot hole extending therethrough, said base being located between said first and second handle sides at said first end of said handle;

(d) a pair of fasteners respectively located adjacent said first and second ends of said handle, interconnecting said first and second handle sides of said handle and holding them parallel with each other, a first one of said fasteners extending through said pivot hole in said tool blade and attaching said tool blade pivotably to said handle;

(e) a flange, extending longitudinally along a portion of said first handle side and directed toward said second handle side, said first handle side and said flange being an integral piece of sheet metal separate and independent from said second handle side; and (f) a spring attached to and extending from said flange and extending generally longitudinally with respect to said handle, said spring having an outer end located so as to contact said base of said tool blade when said tool blade is in a predetermined position with respect to said first handle side.

2. The folding tool of claim 1 wherein said spring is a leaf spring extending from said flange proximate said first end of said handle.

3. The folding tool of claim 2 wherein said second handle side includes a second flange extending longitudinally along a portion thereof and directed toward said first handle side, said second handle side and said second flange being an integral piece of sheet metal separate and independent from said first handle side, said second handle side also including a second leaf spring attached to and extending from said second flange proximate said first end of said handle and extending generally longitudinally with respect to said handle.

4. The folding tool of claim 3, wherein a respective one of said flanges extends along each of said handle sides to respective locations proximate each of said opposite ends of said handle.

5. The folding tool of claim 3 also including a second tool blade having a base defining a pivot hole extending therethrough, said base being located between said first and second handle sides at said first end of said handle and said second leaf spring having an outer end located so as to contact said base of said second tool blade when said second tool blade is in a predetermined position with respect to said second handle side.

6. The folding tool of claim 1 also including a second said handle, each of said handles including a respective one of a pair of tool blades located between said first and second handle sides thereof and attached pivotably thereto by a second one of said pair of fasteners thereof at said second end thereof, said pair of tool blades being interconnected with each other by a pivot joint, and said first and second handle sides of each of said handles being spaced apart from each other and defining a respective cavity therebetween, a respective portion of each of said interconnected pair of tool blades being received in each said cavity when said tool is in a folded configuration.

7. The folding tool of claim 6 wherein said interconnected pair of tool blades are jaws of a pair of pliers.

8. The folding tool of claim 3, wherein said first and second flanges are aligned opposite each other and directed toward each other from the respective ones of said handle sides.

* * * * *